US011614705B2

(12) United States Patent
Takiguchi et al.

(10) Patent No.: US 11,614,705 B2
(45) Date of Patent: Mar. 28, 2023

(54) MOUNTING/DEMOUNTING STRUCTURE, APPARATUS USING MOUNTING/DEMOUNTING STRUCTURE, AND MOUNTABLE/DEMOUNTABLE OBJECT

(71) Applicant: FUJIFILM Business Innovation Corp., Tokyo (JP)

(72) Inventors: Toshio Takiguchi, Kanagawa (JP); Yosuke Shimomoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/404,116

(22) Filed: Aug. 17, 2021

(65) Prior Publication Data

US 2022/0308522 A1 Sep. 29, 2022

(30) Foreign Application Priority Data

Mar. 26, 2021 (JP) ..... JP2021-053533

(51) Int. Cl.
*G03G 21/16* (2006.01)
*G03G 15/08* (2006.01)

(52) U.S. Cl.
CPC ..... *G03G 21/1619* (2013.01); *G03G 21/1633* (2013.01); *G03G 21/1647* (2013.01); *G03G 15/0875* (2013.01); *G03G 2221/163* (2013.01); *G03G 2221/18* (2013.01)

(58) Field of Classification Search
CPC ..... G03G 15/0875; G03G 21/1619; G03G 21/1633; G03G 21/1647; G03G 21/1676; G03G 2221/163; G03G 2221/18
See application file for complete search history.

(56) References Cited

U.S. PATENT DOCUMENTS 10,663,887 B2 5/2020 Kobayashi et al.
2016/0098008 A1* 4/2016 Yuan ..... G03G 21/1647 399/167
2017/0102667 A1* 4/2017 Yuan ..... G03G 21/1647

FOREIGN PATENT DOCUMENTS

JP 2020-052106 A 4/2020

* cited by examiner

*Primary Examiner* — Sophia S Chen
(74) *Attorney, Agent, or Firm* — Sughrue Mion, PLLC

(57) ABSTRACT

A mounting/demounting structure includes: a mountable/demountable object including a body, a first projection provided at a first end of the body in a movable manner, and a second projection provided at a second end of the body in a shiftable manner; and a receptacle including a housing configured to house the object when mounted while covering it in at least two directions, first and second stoppers provided in the housing and configured to stop the first and second projections, respectively by engagement, the object including an abutment portion provided on the body and configured to abut against a part of the housing to keep a posture reduced in terms of an engagement amount between the second projection and the second stopper when the first projection is disengaged from the first stopper and the object is stopped at a tilt in the housing during demounting of the object from the receptacle.

20 Claims, 21 Drawing Sheets

MOUNTING/DEMOUNTING STRUCTURE, APPARATUS USING MOUNTING/DEMOUNTING STRUCTURE, AND MOUNTABLE/DEMOUNTABLE OBJECT

CROSS-REFERENCE TO RELATED APPLICATIONS

This application is based on and claims priority under 35 USC 119 from Japanese Patent Application No. 2021-053533 filed Mar. 26, 2021.

BACKGROUND

(i) Technical Field

The present disclosure relates to a mounting/demounting structure, an apparatus using the mounting/demounting structure, and a mountable/demountable object.

(ii) Related Art

For example, a technology described in Japanese Unexamined Patent Application Publication No. 2020-52106 (Claim 1, FIGS. 2 to 6) is known as a mounting/demounting structure in which a mountable/demountable object such as a toner cartridge is removably mounted on a receptacle such as a mount in an apparatus body.

Japanese Unexamined Patent Application Publication No. 2020-52106 describes a cartridge support unit including a housing having an opening, a cylindrical toner cartridge mountable on or demountable from the housing, a guide member positioned along the sides of the opening in the housing, a shutter body slidable relative to the guide member from a closing position where the shutter body covers the opening to an opening position where the shutter body uncovers the opening, and a snap-fit portion extending from the shutter body, having a projection, and configured to terminate a locked state at the closing position when the projection is pushed by the outer peripheral surface of the toner cartridge.

SUMMARY

Aspects of non-limiting embodiments of the present disclosure relate to a mounting/demounting structure, an apparatus using the mounting/demounting structure, and a mountable/demountable object. The mountable/demountable object includes a body, a first projection provided at one end of the body in a movable manner, and a second projection provided at the other end of the body in a shiftable manner. In the mounting/demounting structure, when the first projection is first disengaged from a first stopper of a housing portion of a receptacle and the mountable/demountable object is stopped at a tilt in the housing portion during demounting of the mountable/demountable object from the housing portion, the mountable/demountable object is demountable more easily than in a case without an abutment portion configured to abut against a part of the housing portion to keep a posture reduced in terms of an engagement amount between the second projection and a second stopper of the housing portion when the mountable/demountable object is stopped at a tilt.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a mounting/demounting structure including: a mountable/demountable object that is mountable or demountable by inserting or pulling the mountable/demountable object including a body, a first projection provided at a first end of the body in a movable manner, and a second projection provided at a second end of the body in a shiftable manner; and a receptacle including a housing portion configured to, when the mountable/demountable object is mounted, house the mountable/demountable object while covering the mountable/demountable object in at least two directions, a first stopper provided in the housing portion and configured to stop the first projection by engagement, and a second stopper provided in the housing portion and configured to stop the second projection by engagement, the mountable/demountable object including an abutment portion provided on the body and configured to abut against a part of the housing portion to keep a posture reduced in terms of an engagement amount between the second projection and the second stopper when the first projection is first disengaged from the first stopper and the mountable/demountable object is stopped at a tilt in the housing portion during demounting of the mountable/demountable object from the receptacle.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure are described below with reference to the drawings.

First Exemplary Embodiment

Figure 1A:
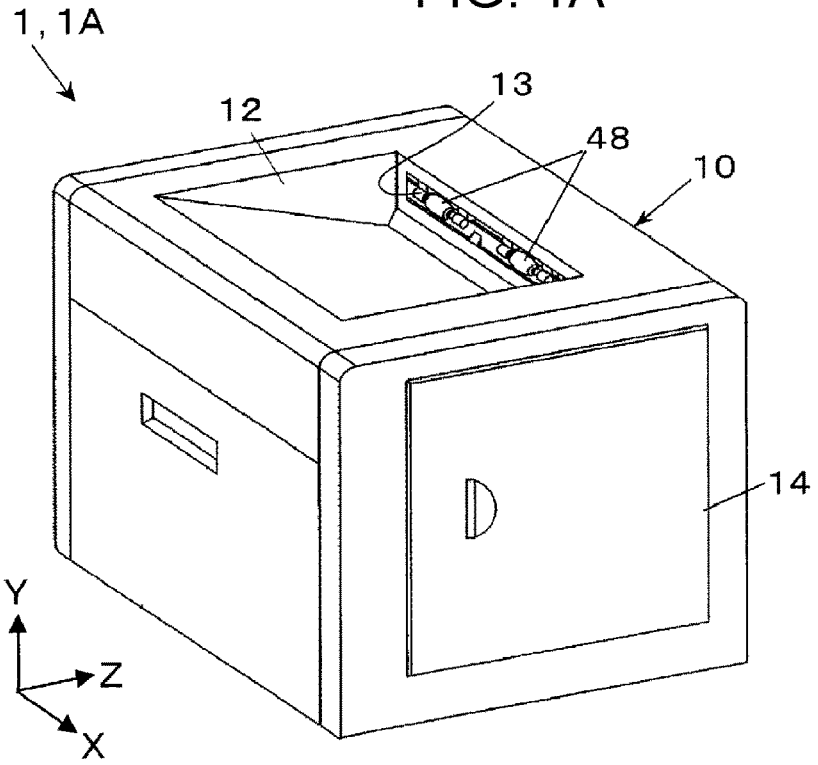
FIG. 1A is a perspective view illustrating the appearance of an image forming apparatus using a mounting/demounting structure according to a first exemplary embodiment.
Figure 1B:
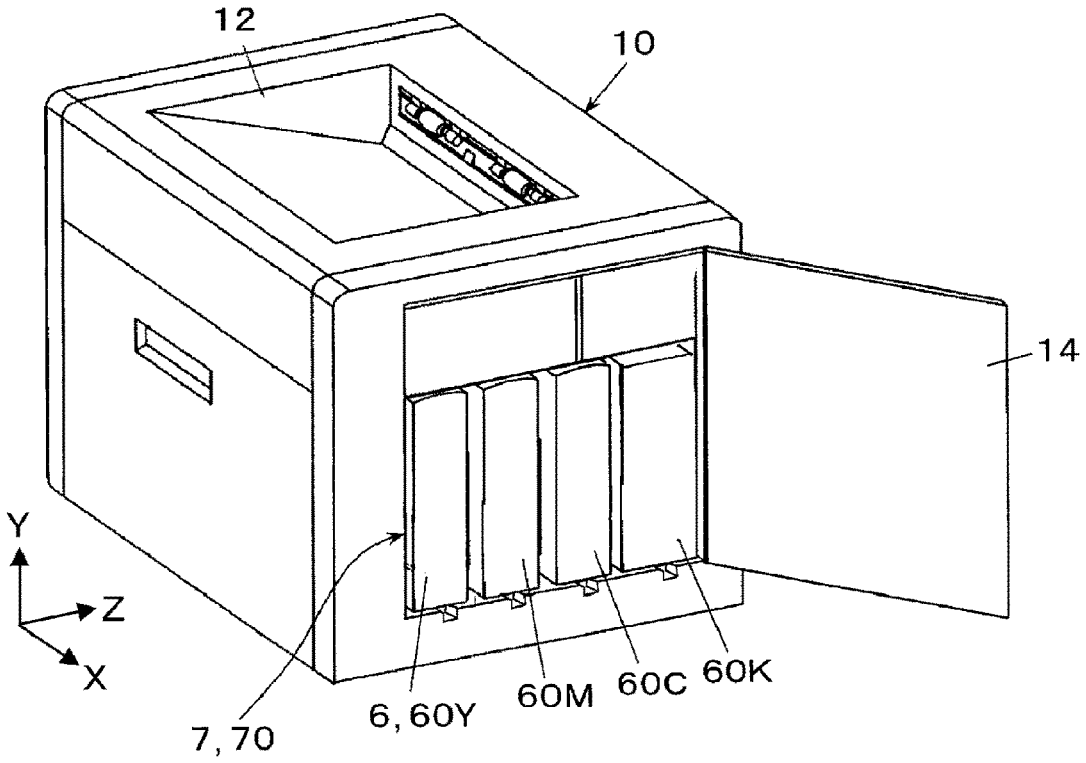
FIG. 1B is a perspective view illustrating the image forming apparatus of FIG. 1A with its side door open.
Figure 2:
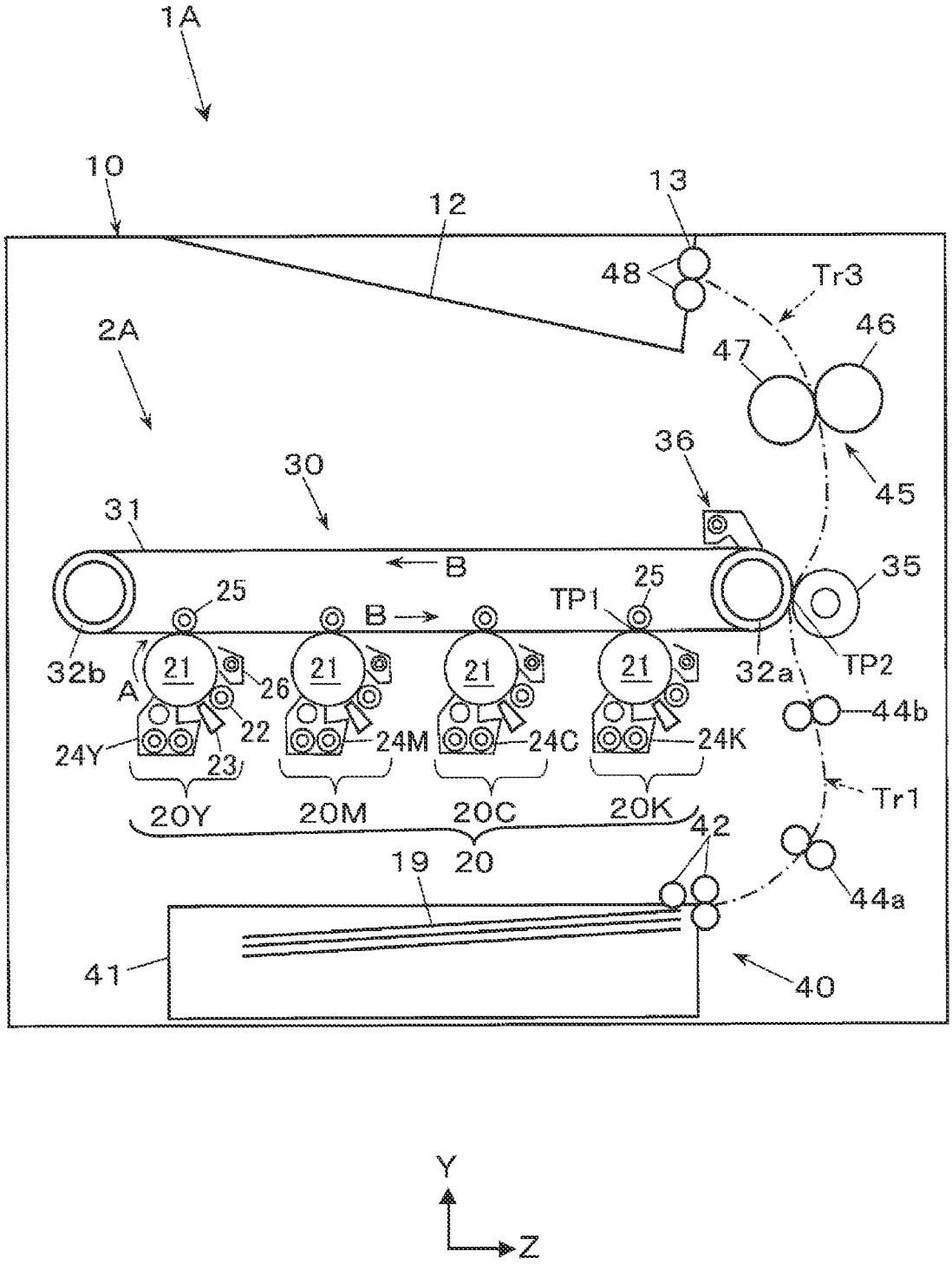
FIG. 2 illustrates the internal structure of the image forming apparatus of FIGS. 1A and 1B.

FIGS. 1A, 1B, and 2 illustrate an image forming apparatus 1A as an example of an apparatus 1 using a mounting/demounting structure 5 according to a first exemplary embodiment. FIGS. 1A and 1B illustrate the appearance of the image forming apparatus 1A. FIG. 2 illustrates the inside of the image forming apparatus 1A.

In the following description, an arrow X direction in the drawings is a width direction at the front of the image forming apparatus 1A. An arrow Y direction is a height direction at the front of the image forming apparatus 1A. An arrow Z direction is a depth direction from the front to the rear of the image forming apparatus 1A and is orthogonal to the width direction and the height direction.

<Image Forming Apparatus>

The image forming apparatus 1A is a printer that forms an image corresponding to input image information on a recording medium 19 in the form of a sheet.

Figure 3:
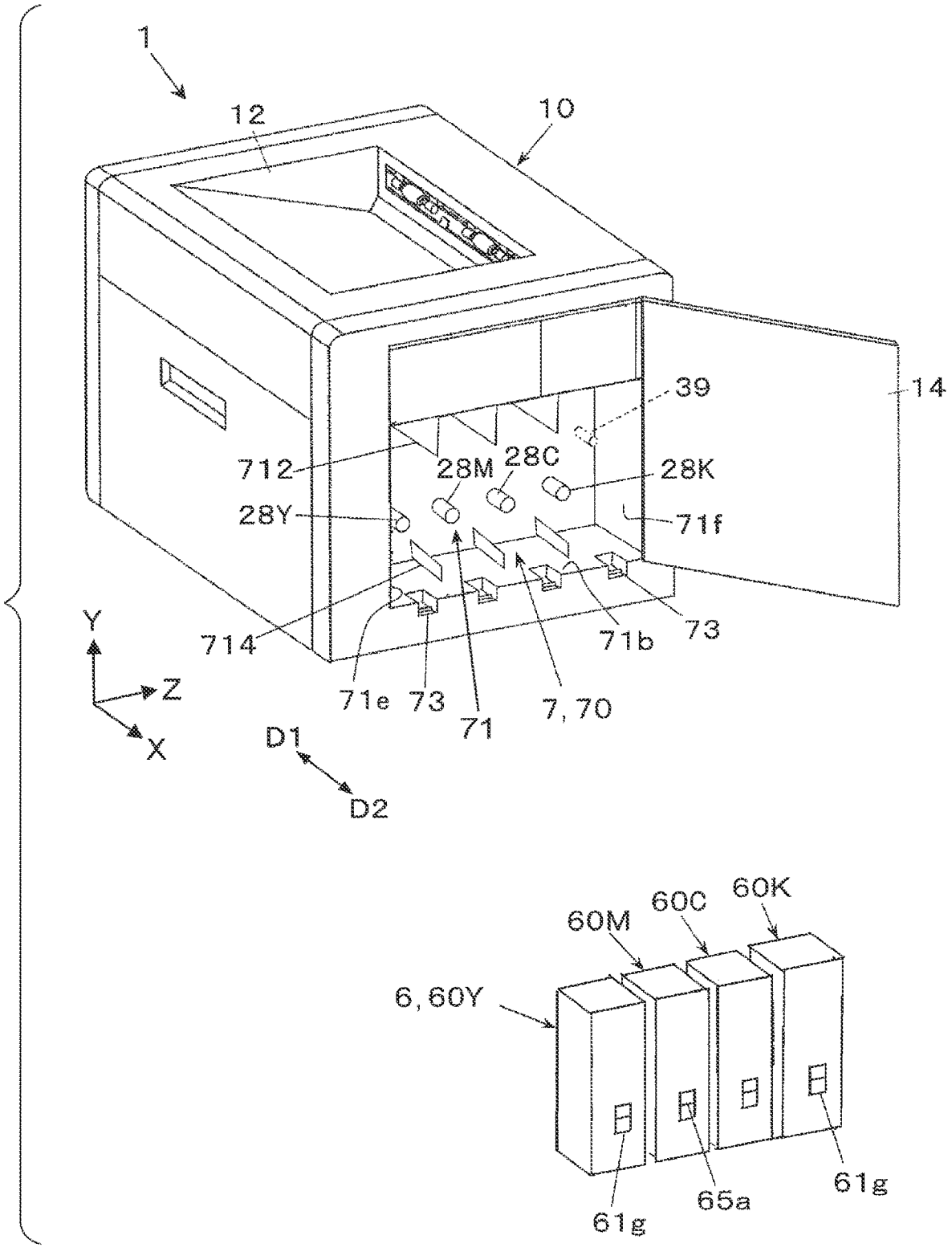
FIG. 3 is a perspective view illustrating the image forming apparatus of FIGS. 1A and 1B with its developer containers demounted.

As illustrated in FIG. 2, the image forming apparatus 1A includes an image former 2A that forms a visible image on the recording medium 19 with a developer using an electrophotographic system or the like. The image former 2A is arranged in a housing 10. As illustrated in FIGS. 1B and 3, the image forming apparatus 1A includes a developer container 60 as an example of a mountable/demountable object 6 removably mounted in the housing 10. The developer container 60 is a mountable/demountable container containing the developer for replenishing the image former 2A.

For example, the housing 10 is a box-shaped structure formed by assembling materials such as a support frame and outer panels. The housing 10 has, at the top, an output receiver 12 that receives the recording medium 19 output to the outside after the image is formed. The housing 10 has an openable/closable side door 14 on its one side. In a space behind the side door 14, the housing 10 has a container mount 70 as an example of a receptacle 7 where the developer container 60 is removably mounted.

The mounting/demounting structure 5 according to the first exemplary embodiment includes the developer container 60 and the container mount 70. Details thereof are described later.

As illustrated in FIG. 2, the image former 2A includes a toner image former 20, an intermediate transfer device 30, a medium feeder 40, and a fixing device 45. The toner image former 20 forms a visible toner image by developing, with the developer, a latent image formed based on image information. The intermediate transfer device 30 temporarily carries the toner image formed by the toner image former 20 and then secondly transfers the toner image on the recording medium 19. The medium feeder 40 contains the recording medium 19 and feeds the recording medium 19 to a toner image transfer position. The fixing device 45 fixes the transferred toner image onto the recording medium 19. Examples of the developer include a two-component developer including a toner and a carrier.

For example, the toner image former 20 includes four toner image formers 20Y, 20M, 20C, and 20K dedicated to forming yellow (Y), magenta (M), cyan (C), and black (K) toner images, respectively.

As illustrated in FIG. 2, each of the four toner image formers 20Y, 20M, 20C, and 20K includes a drum-shaped photoconductor 21 as an example of an image carrier that rotates in an arrow A direction and carries a latent image and a visible image.

Each of the toner image formers 20Y, 20M, 20C, and 20K includes a charging device 22, an exposing device 23, a developing device 24Y, 24M, 24C, or 24K, a first transfer device 25, and a first cleaner 26 around the photoconductor 21. The charging device 22 charges the outer peripheral surface of the photoconductor 21 at an appropriate potential. The exposing device 23 forms an electrostatic latent image on the charged outer peripheral surface of the photoconductor 21 by light exposure based on the image information. The developing device 24Y, 24M, 24C, or 24K develops the electrostatic latent image into a visible toner image with the developer (toner in actuality). The first transfer device 25 transfers the toner image onto the intermediate transfer device 30. The first cleaner 26 cleans the outer peripheral surface of the photoconductor 21. In FIG. 2, all the reference symbols 21 to 26 are placed on the yellow (Y) toner image former 20Y, and the reference symbols are partially placed on the other toner image formers 20M, 20C, and 20K.

As illustrated in FIG. 2, the intermediate transfer device 30 includes an intermediate transfer belt 31 that carries and transports toner images. The intermediate transfer belt 31 is an endless belt having an outer peripheral surface that may carry the toner images by an electrostatic force, and is supported by a plurality of support rollers 32 (e.g., two support rollers 32*a* and 32*b*) arranged on the inner side to rotate in an arrow B direction sequentially through first transfer positions TP1 where the intermediate transfer belt 31 is in contact with the photoconductors 21 of the toner image formers 20Y, 20M, 20C, and 20K. The intermediate transfer belt 31 is in contact with each photoconductor 21 by the first transfer device 25.

The intermediate transfer device 30 includes a second transfer device 35 and a second cleaner 36 around the intermediate transfer belt 31. The second transfer device 35 secondly transfers, onto the recording medium 19, the toner images firstly transferred onto the intermediate transfer belt 31. The second cleaner 36 cleans the outer peripheral surface of the intermediate transfer belt 31.

The medium feeder 40 includes a container 41 and a sender 42. The container 41 contains a stack of recording media 19 and is drawable out of the housing 10. The sender 42 sends the recording media 19 in the container 41 one by one.

The medium feeder 40 is connected to a feed-transport path Tr1 defined by a pair of transport rollers 44*a* and 44*b* and guide members (not illustrated) that feed the sent recording medium 19 to a second transfer position of the intermediate transfer device 30. Examples of the recording medium 19 include plain paper, coated paper, cardboard, an envelope, and any other sheet medium that may be transported in the housing 10 and subjected to transfer and fixing of toner images.

The fixing device 45 includes a heating rotator 46 including a heater (not illustrated) and provided in the form of a roller or a nip belt, and a pressurizing rotator 47 provided in the form of a roller. The heating rotator 46 and the pressurizing rotator 47 are provided in an internal space of a housing (not illustrated) having an entrance and an exit for the recording medium 19. The fixing device 45 performs a fixing process at a nip where the heating rotator 46 heated at an appropriate temperature and the pressurizing rotator 47 are in press contact with each other at an appropriate pressure.

The fixing device 45 is connected to an output-transport path Tr3 defined by a pair of output rollers 48 and guide members (not illustrated) that output the recording medium 19 having the fixed toner images through an exit 13 in the housing 10.

<Image Forming Operation>

In response to an image forming operation command from a controller (not illustrated), the image forming apparatus 1A performs the following image forming operation using the image former 2A.

In each of the toner image formers 20Y, 20M, 20C, and 20K, the charging device 22 charges the photoconductor 21 rotating in the arrow A direction, the exposing device 23 exposes the photoconductor 21 with light, and the developing device 24Y, 24M, 24C, or 24K develops a latent image. Those operations are performed in this order. Thus, four-color (Y, M, C, K) toner images are formed exclusively on the outer peripheral surfaces of the respective photoconductors 21. For example, a yellow (Y) toner image is formed on the outer peripheral surface of the photoconductor 21 of the toner image former 20Y, and a magenta (M) toner image is formed on the outer peripheral surface of the photoconductor 21 of the toner image former 20M.

In the intermediate transfer device 30, the first transfer devices 25 of the toner image formers 20Y, 20M, 20C, and 20K perform first transfer operations at the first transfer positions TP1 where the first transfer devices 25 face the intermediate transfer belt 31 rotating in the arrow B direction. Thus, the toner images formed on the photoconductors 21 are firstly transferred onto the intermediate transfer belt 31 at predetermined timings. After the first transfer, the outer peripheral surface of each photoconductor 21 is cleaned by the first cleaner 26 by removing waste such as a residual toner.

In the intermediate transfer device 30, the second transfer device 35 performs a second transfer operation at a second transfer position TP2 where the second transfer device 35 faces the intermediate transfer belt 31. Thus, the toner images firstly transferred onto the intermediate transfer belt 31 are secondly transferred collectively onto one side of the recording medium 19 fed from the medium feeder 40. After the second transfer, the outer peripheral surface of the intermediate transfer belt 31 is cleaned by the second cleaner 36 by removing waste such as a residual toner.

In the medium feeder 40, the sender 42 is activated in synchronization with a timing of the second transfer of the toner images to send the recording media 19 from the container 41 one by one. Each recording medium 19 sent from the medium feeder 40 is transported to the second transfer position TP2 of the intermediate transfer device 30 via the feed-transport path Tr1.

The fixing device 45 performs a fixing operation such that the recording medium 19 sent from the second transfer position TP2 with the toner images secondly transferred is transported through the nip where the heating rotator 46 and the pressurizing rotator 47 are in press contact with each other. Thus, the toner images on the recording medium 19 are fixed onto one side of the recording medium 19 by fusing under pressure through the fixing process involving heating and pressurizing at the nip.

After the fixing operation of the fixing device 45, the recording medium 19 is transported to the exit 13 via the output-transport path Tr3, output from the housing 10 through the exit 13, and received on the output receiver 12.

The basic image forming operation is completed in this manner.

For example, the image forming apparatus 1A may arbitrarily select different types of image forming operation typified by an operation of forming a multi-color image by combining toner images of two or more colors out of the four colors (Y, M, C, K) through the operations of two or more toner image formers out of the four toner image formers 20Y, 20M, 20C, and 20K, and an operation of forming a single-color image (e.g., a monochrome image) from a single-color toner image by operating one of the four toner image formers 20Y, 20M, 20C, and 20K.

In the image forming apparatus 1A, the developer (toner) is consumed and its amount decreases in each of the developing devices 24Y, 24M, 24C, and 24K through the image forming operation or the like. Therefore, an appropriate amount of developer is supplied from the developer container 60 at an appropriate timing.

<Mounting/Demounting Structure>

Next, description is made of the mounting/demounting structure 5 including the developer container 60 and the container mount 70 in the image forming apparatus 1A.

As illustrated in FIG. 3, the developer container 60 includes four developer containers 60Y, 60M, 60C, and 60K containing developers of four colors to be supplied to the developing devices 24Y, 24M, 24C, and 24K of the image former 2A, respectively. The developer in the developer container 60 may be a toner alone, but may contain an appropriate amount of carrier. The four developer containers 60Y, 60M, 60C, and 60K may hereinafter be represented simply by "developer container 60".

The four developer containers 60Y, 60M, 60C, and 60K are mounted or demounted by being inserted into or pulled from the container mount 70 of the housing 10 along an inserting or pulling direction indicated by an arrow D1 or D2. As illustrated in FIG. 1B, the four developer containers 60Y, 60M, 60C, and 60K are mounted on the container mount 70 side by side in proximity to each other.

Each of the developer containers 60Y, 60M, 60C, and 60K in the mounting/demounting structure 5 includes a container-shaped body 61 containing a developer to be supplied, a first projection 63 provided at one end of the body 61 to move in a vertical direction, and a second projection 67 provided at the other end of the body 61 to shift in the vertical direction by elasticity.

Figure 4:
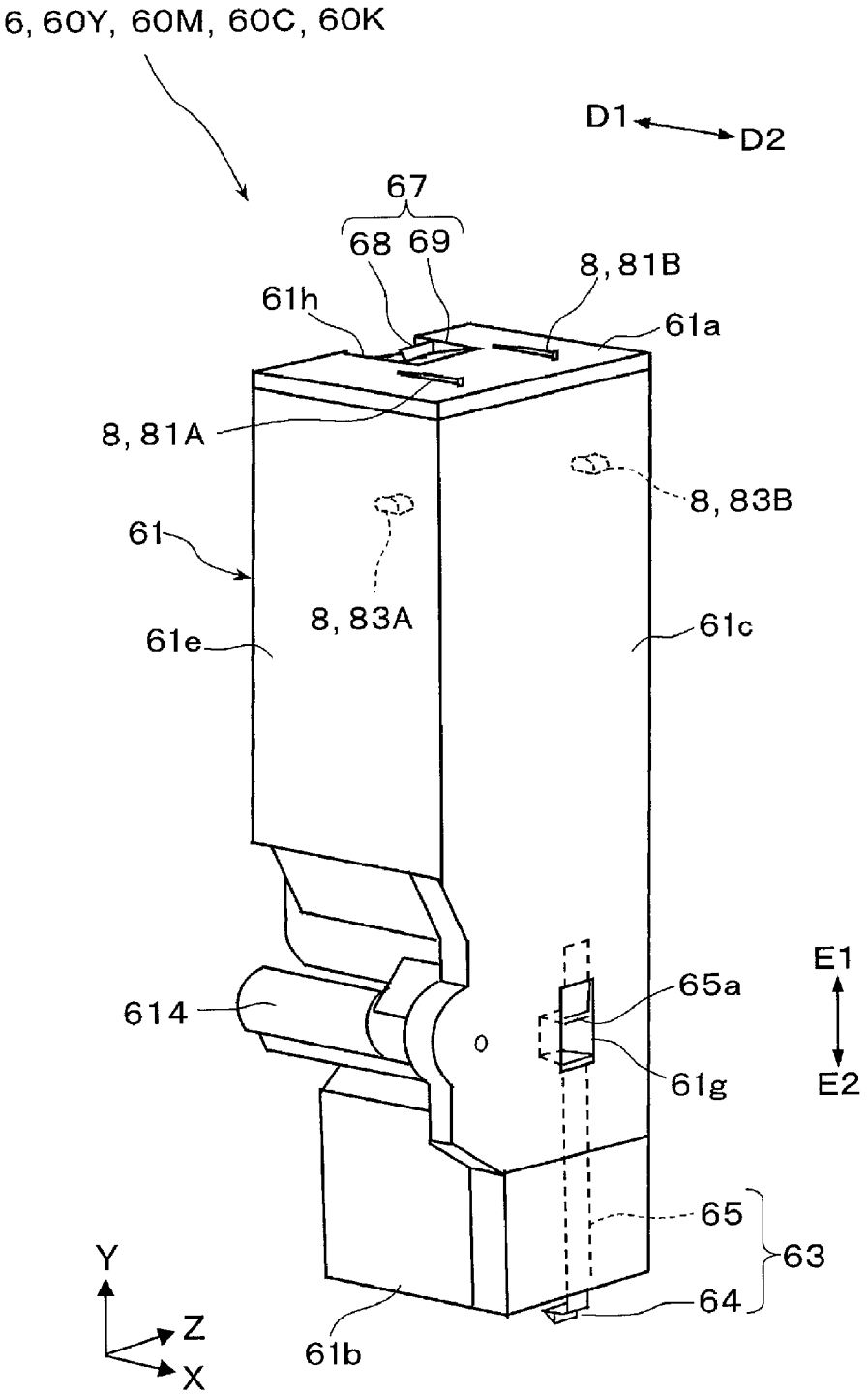
FIG. 4 is a perspective view illustrating the developer container.
Figure 5:
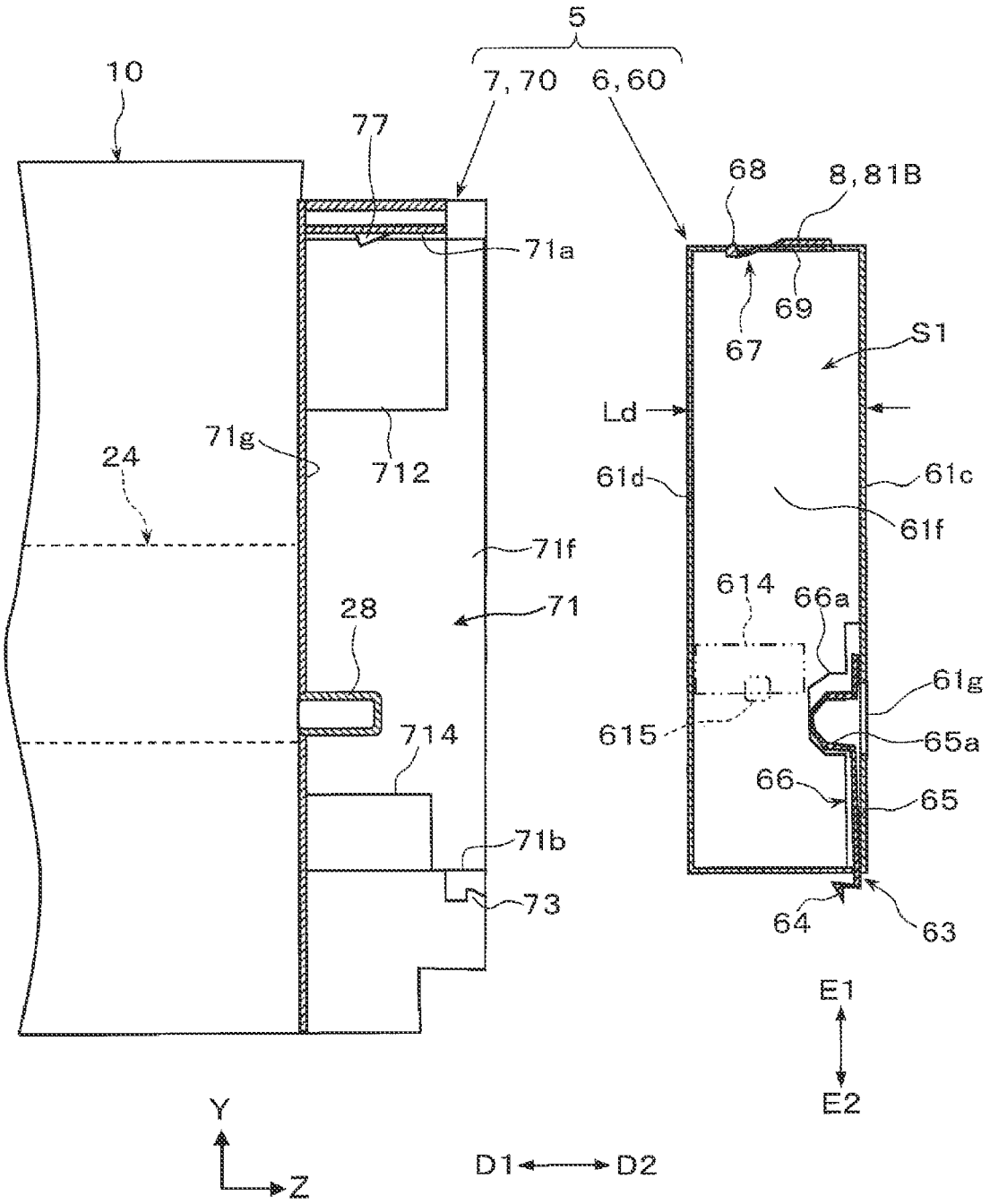
FIG. 5 is a vertical sectional view illustrating the developer container and a container mount in the mounting/demounting structure according to the first exemplary embodiment.
Figure 6:
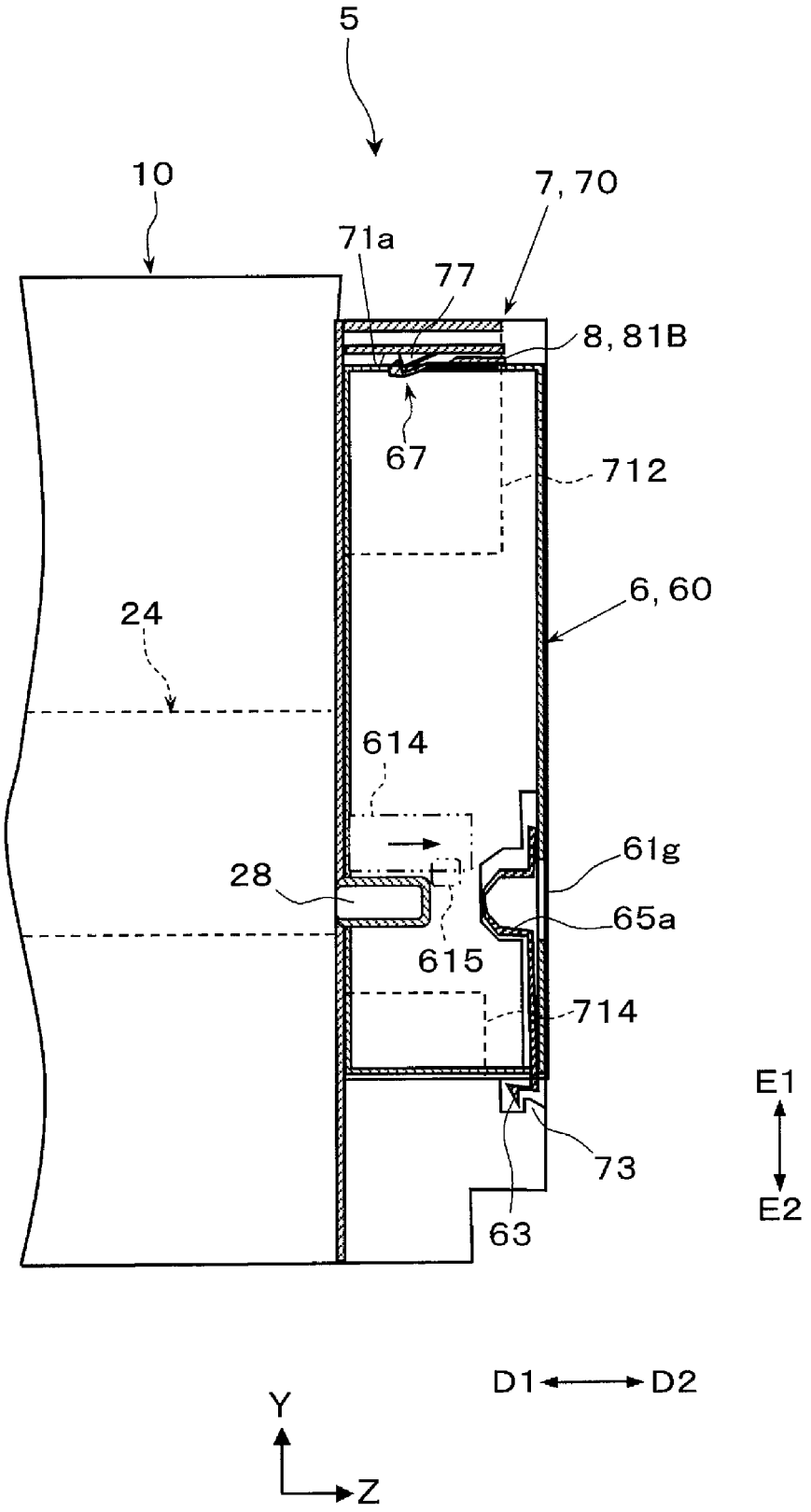
FIG. 6 is a vertical sectional view illustrating the developer container of FIG. 5 mounted on the container mount.

As illustrated in FIGS. 4 to 6, the body 61 of the developer container 60 has a substantially vertically long rectangular parallelepiped shape in appearance, and has a containing space S1 that contains the developer. In appearance, the body 61 has an upper end 61*a*, a lower end 61*b*, a front side 61*c*, a rear side 61*d*, a left side 61*e*, and a right side 61*f*.

Figure 7:
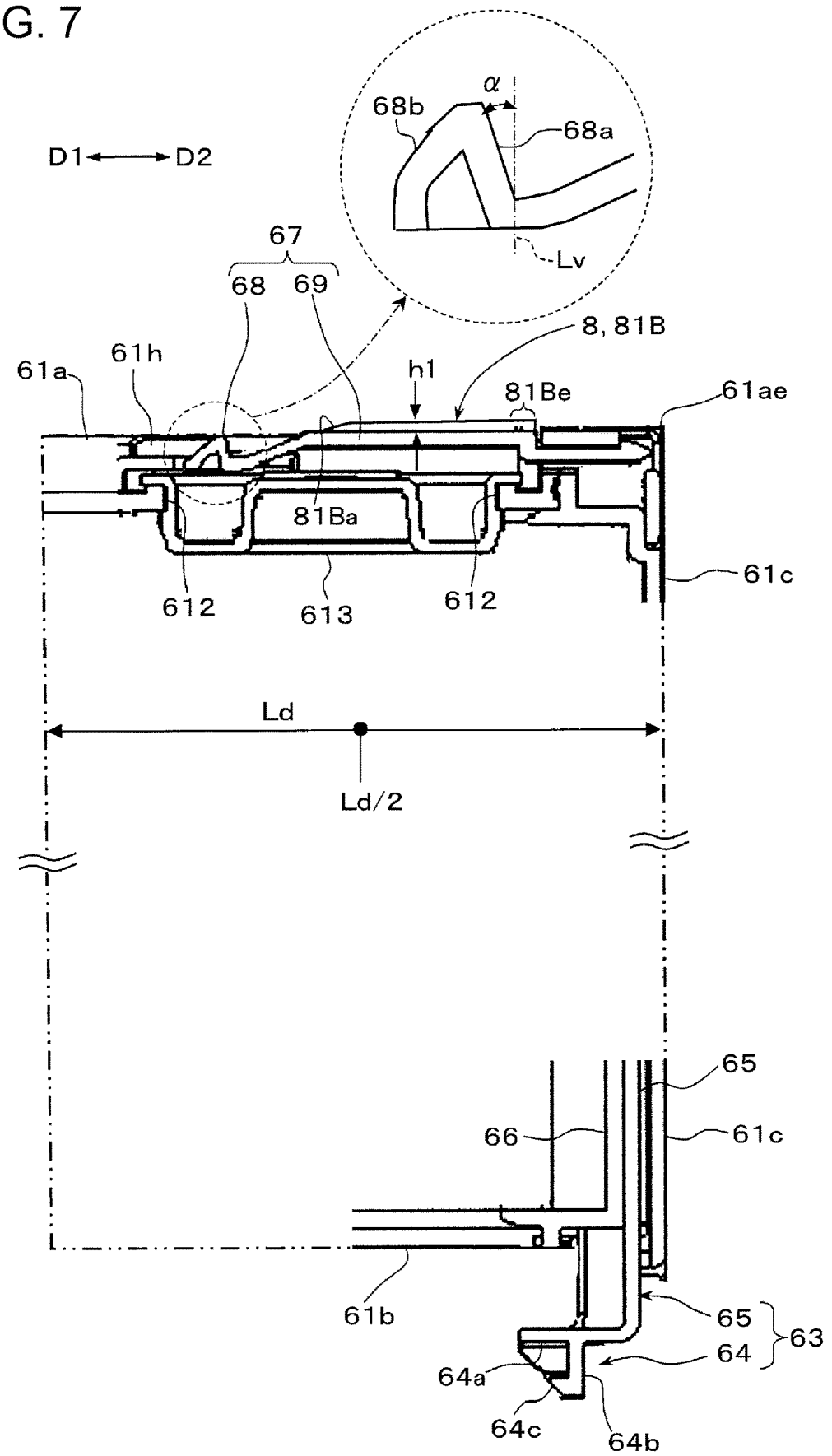
FIG. 7 illustrates a principal part of the developer container.

As illustrated in FIG. 7, the body 61 has, at its upper end, a charging port 612 to be used for charging the developer, and a lid 613 that closes the charging port 612.

The body 61 has, at its lower part, a dispenser 614 including a transport member (not illustrated) that sends the developer in the containing space S1 during replenishment. The dispenser 614 has an open/close lid 615 movable in directions along the inserting and pulling directions D1 and D2 to open or close an outlet (not illustrated) of the developer. The open/close lid 615 is urged in the inserting direction D1 by an urging member such as a coil spring (not illustrated) to stay at an outlet closing position unless an external force is applied.

The first projection 63 of the developer container 60 is provided at the lower end 61*b* that is an example of the one end of the body 61. In the lower end 61*b*, the first projection 63 is provided near an upstream end in the inserting direction D1, in other words, near the front side 61*c*.

In the first exemplary embodiment, the first projection 63 includes a protrusion 64 that protrudes downward from the lower end 61*b* of the body 61, and a support 65 that supports the protrusion 64 to move the protrusion 64 in the vertical direction.

As illustrated in FIG. 7, the protrusion 64 has a support surface 64*a* along the inserting and pulling directions D1 and D2, a downward surface 64*b* that extends in the gravity direction from the support surface 64*a* and engages in contact with a first stopper 73 described later, and an entry slope 64*c* inclined upward in the inserting direction D1 from the lower end of the downward surface 64*b*.

The support 65 extends substantially linearly upward from the protrusion 64, and has a bent manipulator 65*a* provided in the middle and bent to recede toward the inside of the containing space S1 of the body 61.

The support 65 is held by a holding member 66 and is movable by an appropriate distance in upward and downward directions E1 and E2 while being housed in a holding space between the holding member 66 and the inner surface of the front side 61*c* of the body 61. The appropriate distance is a movement distance for disengaging the first projection 63 from the first stopper 73.

The holding member 66 has a protrusion 66*a* provided at a part corresponding to the bent manipulator 65*a* of the support 65 and protruding toward the inside of the containing space S1 of the body 61 to hold the bent manipulator 65*a* in a vertically movable manner. A manipulation opening 61*g* is provided in the front side 61*c* of the body 61 at a part corresponding to the protrusion 66*a* of the holding member 66. A user's finger is inserted through the manipulation opening 61*g* to move the bent manipulator 65*a* of the support 65 in the protrusion 66*a* upwardly when demounting the developer container 60.

When the developer container 60 is mounted, the protrusion 64 of the first projection 63 is positioned at the lowest point within a vertically movable range. When demounting the developer container 60, the first projection 63 disengages from the first stopper 73 by moving the protrusion 64 in the upward direction E1 within the vertically movable range. The first projection 63 moves by its weight to the lowest point within the vertically movable range, or is urged in the downward direction E2 by an urging member such as a spring to move to the lowest point within the vertically movable range.

As illustrated in FIGS. 5 and 7, the second projection 67 of the developer container 60 is provided at the upper end 61*a* that is an example of the other end of the body 61. That is, the second projection 67 is arranged opposite the first projection 63 across the body 61.

In the first exemplary embodiment, the second projection 67 includes a protrusion 68 that protrudes upward from the upper end 61*a* of the body 61, and an elastic support 69 that supports the protrusion 68 to shift the protrusion 68 in the vertical direction.

As illustrated in FIGS. 5 and 7, the protrusion 68 is bent into a mountain-like shape so that its crest protrudes by an appropriate amount from the upper end 61*a*. The protrusion 68 has a rising surface 68*a* that rises upward and engages in contact with a second stopper 77 described later, and a tip slope 68*b* that extends obliquely downward from the upper end of the rising surface 68*a*.

The elastic support 69 is a plate portion extending from the lower end of the rising surface 68*a* of the protrusion 68 in a direction opposite to that of the tip slope 68*b*. The elastic support 69 is made of a material such as a synthetic resin having elasticity enough to deflect to support the protrusion 68 so that the protrusion 68 is shifted downward.

As illustrated in FIGS. 4, 5, and 7, the protrusion 68 of the second projection 67 is arranged in a cutout recess 61*h* provided on the upper end 61*a* of the body 61 at a position on a downstream side of the middle of a dimension Ld (Ld/2) along the inserting direction D1 in which the developer container 60 is mounted. The dimension Ld corresponds substantially to the maximum separation distance between the front side 61*c* and the rear side 61*d* of the body 61.

In the first exemplary embodiment, the protrusion 68 and the elastic support 69 of the second projection 67 are integrally molded of the same material (e.g., a synthetic resin). The second projection 67 may be a component attached to an upper cover at the upper end 61*a* of the body 61, or may be formed integrally as a part of the upper cover.

When the developer container 60 is mounted, the protrusion 68 is located at the highest position that is a normal position and the second projection 67 engages with the second stopper 77. While the developer container 60 is being mounted or demounted, the protrusion 68 comes into contact with the second stopper 77 and is shifted downward by elastic deformation of the elastic support 69. Thus, the second projection 67 climbs over the second stopper 77.

That is, the second projection 67 is a so-called snap-fit component that engages with the second stopper 77 after the protrusion 68 is shifted downward by deflection.

The container mount 70 in the mounting/demounting structure 5 includes a housing portion 71 that houses the four developer containers 60Y, 60M, 60C, and 60K while covering the mounted developer containers 60Y, 60M, 60C, and 60K from upper, lower, right, and left sides, the first stopper 73 that is provided in the housing portion 71 and stops the first projection 63 by engagement, and the second stopper 77 that is provided in the housing portion 71 and stops the second projection 67 by engagement.

The housing portion 71 of the container mount 70 is formed on one side of the housing 10 of the image forming apparatus 1A and has a space receding toward the inside of the housing 10.

The receding space of the housing portion 71 has a substantially rectangular parallelepiped shape including a ceiling 71*a*, a bottom 71*b*, a left wall 71*e*, a right wall 71*f*, and a back wall 71*g*.

A height dimension that is a separation distance between the ceiling 71*a* and the bottom 71*b* is set slightly larger than a height dimension of the body 61 of the developer container 60. Thus, the housing portion 71 houses the developer container 60 while covering the developer container 60 in proximity from the upper and lower sides with clearances of about several millimeters between the ceiling 71*a* and the upper end 61*a* of the body 61 and between the bottom 71*b* and the lower end 61*b* of the body 61.

As illustrated in FIGS. 3 and 5, the housing portion 71 includes, in the receding space, three upper partition plates 712 and three lower partition plates 714 that define four dedicated housing spaces that house the four developer containers 60Y, 60M, 60C, and 60K side by side.

The four housing spaces in the housing portion 71 are a housing space dedicated to the developer container 60Y, which is defined by the left wall 71*e* and the upper partition plate 712 and the lower partition plate 714 on the left, a housing space dedicated to the developer container 60M, which is defined by the upper partition plate 712 and the lower partition plate 714 on the left and the upper partition plate 712 and the lower partition plate 714 at the center, a housing space dedicated to the developer container 60C, which is defined by the upper partition plate 712 and the lower partition plate 714 at the center and the upper partition plate 712 and the lower partition plate 714 on the right, and a housing space dedicated to the developer container 60K, which is defined by the upper partition plate 712 and the lower partition plate 714 on the right and the right wall 71*f*.

The housing portion 71 houses the four developer containers 60Y, 60M, 60C, and 60K while covering the bodies 61 of the mounted developer containers 60Y, 60M, 60C, and 60K from the right and left sides by the left wall 71*e*, the three upper partition plates 712, the three lower partition plates 714, and the right wall 71*f* with clearances of about 1 or 2 mm.

As illustrated in FIGS. 3 and 5, the housing portion 71 includes four replenishment transport portions 28Y, 28M, 28C, and 28K protruding from the back wall 71*g*. The replenishment transport portions 28Y, 28M, 28C, and 28K receive the developers supplied from the developer containers 60 and transport the developers to the predetermined developing devices 24Y, 24M, 24C, and 24K, respectively.

When mounting the developer container 60, each of the replenishment transport portions 28Y, 28M, 28C, and 28K is connected to the dispenser 614 of the developer container 60. When mounting the developer container 60, each of the replenishment transport portions 28Y, 28M, 28C, and 28K pushes the open/close lid 615 of the dispenser 614 in the pulling direction D2 of the developer container 60 to open the outlet.

Figure 8:
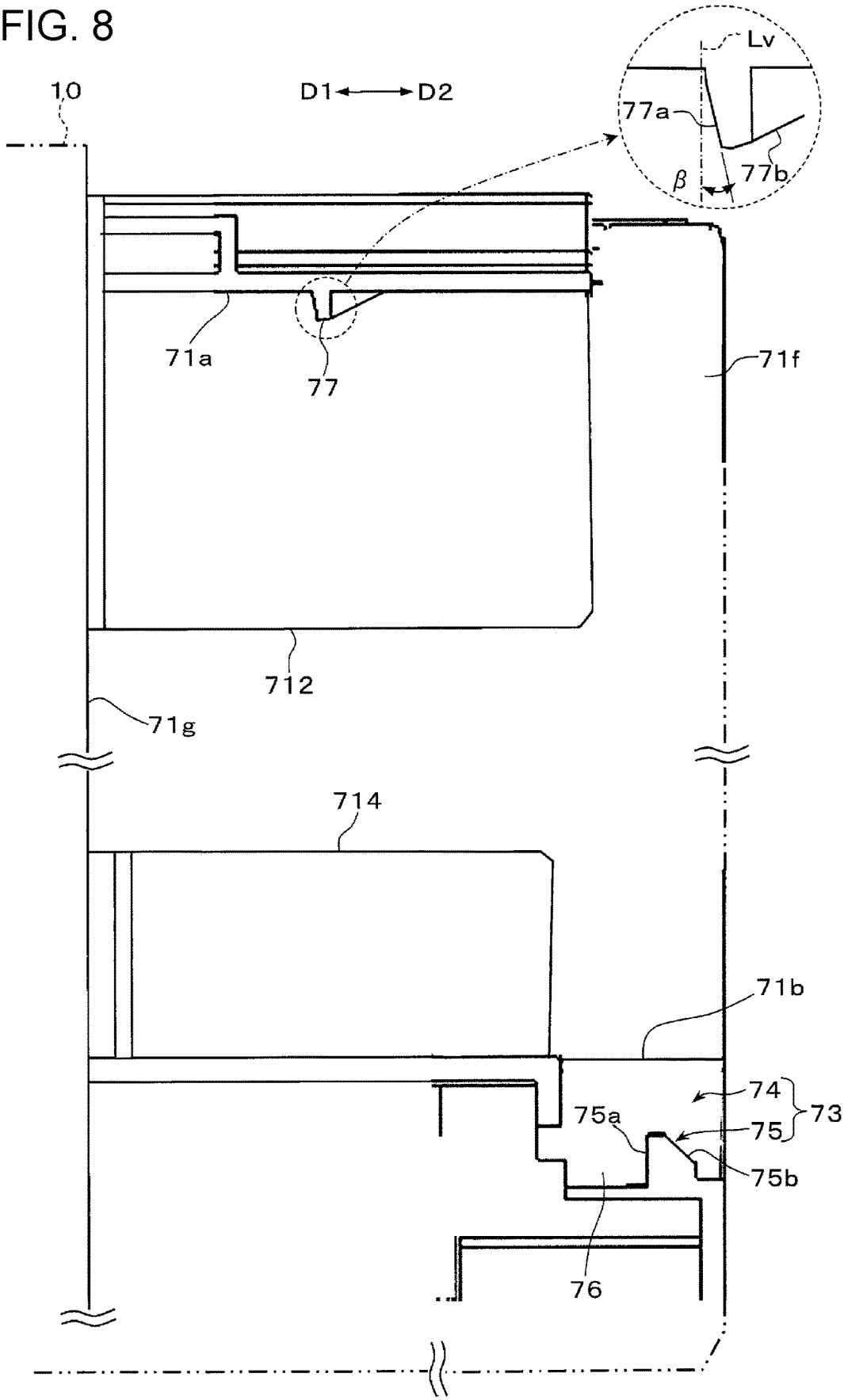
FIG. 8 illustrates a principal part of the container mount.

As illustrated in FIGS. 5 and 8, the first stopper 73 of the container mount 70 is provided at the bottom 71*b* of the housing portion 71. More specifically, the first stopper 73 is provided at an inlet-side end of the bottom 71*b* of the housing portion 71, and substantially faces and engages with the first projection 63 (protrusion 65) of the mounted developer container 60.

As illustrated in FIGS. 3 and 8, the first stopper 73 includes a box-shaped recess 74 open to the front and top at the inlet-side end of the bottom 71*b* of the housing portion 71, and a protrusion 75 provided at the bottom of the recess 74.

As illustrated in FIG. 8, the protrusion 75 has a vertical surface 75*a* that rises substantially at a right angle from the bottom of the recess 74 and engages in contact with the downward surface 64*b* of the first projection 63, and a guide slope 75*b* inclined downward from the upper end of the vertical surface 75*a* to the outside of the housing portion 71. The recess 74 defines a clearance 76 behind the vertical surface 75*a* of the protrusion 75 to receive the protrusion 64 of the first projection 63.

As illustrated in FIGS. 5 and 8, the second stopper 77 of the container mount 70 is provided at the ceiling 71*a* of the housing portion 71. More specifically, the second stopper 77 is provided on a deep side of the ceiling 71*a* of the housing portion 71, in other words, a position where the second stopper 77 substantially faces and engages with the second projection 67 (portion between the protrusion 68 and the elastic support 69) of the mounted developer container 60.

The second stopper 77 has a downward surface 77*a* that extends downward from the ceiling 71*a* of the housing portion 71, and a guide slope 77*b* that obliquely rises from the lower end of the downward surface 77*a* toward the inlet of the housing portion 71.

<Mounting and Demounting of Developer Container>

In the mounting/demounting structure 5, the developer containers 60Y, 60M, 60C, and 60K are mounted on the container mount 70 as follows.

For example, the developer containers 60Y, 60M, 60C, and 60K in the pre-mounted state illustrated in FIGS. 3 and 5 are sequentially pushed by the user of the image forming apparatus 1A in the inserting direction D1 into the predetermined housing spaces of the container mount 70, and are mounted as illustrated in FIGS. 1B and 6.

At this time, the developer container 60 is housed in the housing portion 71 of the container mount 70 while being covered from the upper and lower sides by the ceiling 71*a* and the bottom 71*b* and from the right and left sides by any combination of the left wall 71*e*, the three upper partition plates 712, the three lower partition plates 714, and the right wall 71*f*. In the mounting, the lower end 61*b* of the body 61 of the developer container 60 slides along the bottom 71*b* of the housing portion 71.

As illustrated in FIG. 6, the mounting is completed when the first projection 63 of the developer container 60 is stopped by engagement with the first stopper 73 of the container mount 70 and the second projection 67 is stopped by engagement with the second stopper 77 of the container mount 70.

Figure 9A:
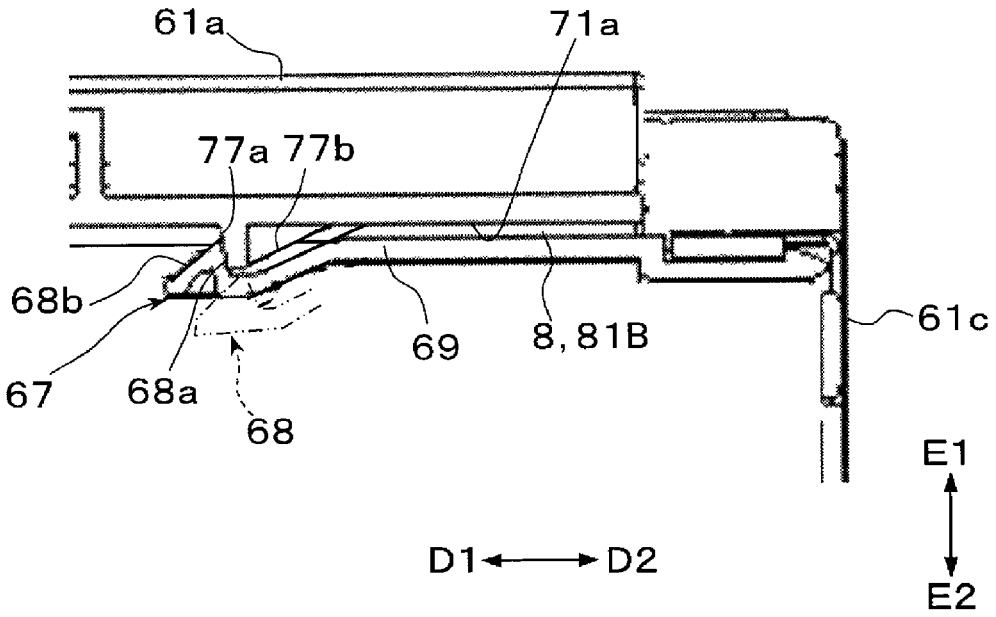
FIG. 9A is a schematic sectional view illustrating upper parts of the mounted developer container and the container mount.
Figure 9B:
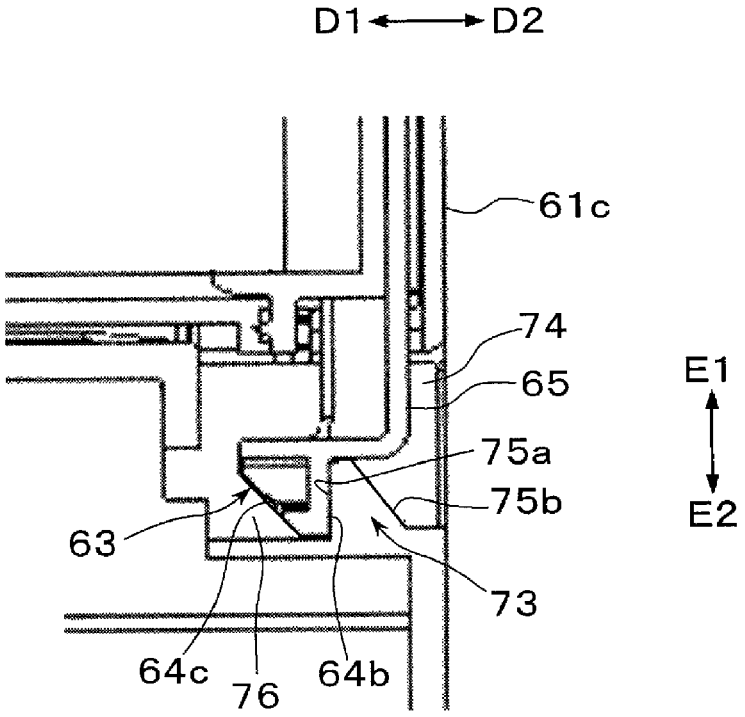
FIG. 9B is a schematic sectional view illustrating lower parts of the mounted developer container and the container mount.

As illustrated in FIGS. 7 and 9B, the protrusion 64 of the first projection 63 is movably supported by the support 65. The protrusion 64 temporarily moves in the upward direction E1 to climb the guide slope 75*b* of the protrusion 75 of the first stopper 73 via the entry slope 64*c*, and returns in the downward direction E2 when passing over the guide slope 75*b*. Thus, the first projection 63 is stopped by engagement such that the downward surface 64*b* of the protrusion 64 faces the vertical surface 75*a* of the protrusion 75 of the first stopper 73 in contact.

As illustrated in FIG. 9A, the protrusion 68 of the snap-fit second projection 67 is pushed gradually downward by the guide slope 77*b* of the second stopper 77 via the tip slope 68*b*, and the second projection 67 is temporarily shifted in the downward direction E2 (indicated by two-dot chain lines in FIG. 9A) by deflection of the elastic support 69. When passing over the guide slope 77*b*, the second projection 67 is shifted back in the upward direction E1 by an elastic restoration force of the elastic support 69. Thus, the second projection 67 is stopped by engagement such that the rising surface 68*a* of the protrusion 68 faces the downward surface 77*a* of the second stopper 77 in contact.

Through the mounting operation described above, the four developer containers 60Y, 60M, 60C, and 60K are mounted on the housing portion 71 of the container mount 70 side by side in proximity to each other as illustrated in FIG. 1B.

In the mounting, the engagement of the first projection 63 with the first stopper 73 and the engagement of the second projection 67 with the second stopper 77 occur substantially at the same timing.

When each of the developer containers 60Y, 60M, 60C, and 60K is mounted on the housing portion 71 of the container mount 70, the replenishment transport portion 28 of the housing portion 71 comes into contact with the open/close lid 615 of the dispenser 614 of the developer container 60, and pushes the open/close lid 615 toward an upstream side in the inserting direction D1 against an urging force of the urging member (not illustrated), thereby opening the outlet of the dispenser 614. Thus, the dispenser 614 of the developer container 60 is connected to the replenishment transport portion 28 and the developer is suppliable to the developing device 24.

The mounted developer container 60 remains pushed in the pulling direction D2 because of a reaction force against the urging force of the urging member. When the mounting of the developer container 60 is completed, the downward surface 64*b* of the first projection 63 is pushed against the vertical surface 75*a* of the protrusion 75 of the first stopper 73 by the reaction force to stabilize the engagement of the first projection 63 with the first stopper 73.

In the mounting/demounting structure 5, the developer containers 60Y, 60M, 60C, and 60K are demounted from the container mount 70 as follows.

For example, the developer containers 60Y, 60M, 60C, and 60K in the mounted state illustrated in FIGS. 1B and 6 are sequentially pulled by the user of the image forming apparatus 1A in the pulling direction D2 from the predetermined housing spaces of the container mount 70, and are demounted as illustrated in FIGS. 3 and 5.

At this time, the developer container 60 is pulled along the pulling direction D2 from the housing portion 71 of the container mount 70 while the user inserts his/her finger into the manipulation opening 61*g* of the body 61 to lift the bent manipulator 65*a* of the support 65 of the first projection 63 in the upward direction E1.

At this time, the developer container 60 may be pulled because the protrusion 64 of the first projection 63 is moved in the upward direction E1 and disengaged from the first stopper 73. At the start of movement of the developer container 60 in the pulling direction D2, the protrusion 68 of the second projection 67 is shifted downward by deflection of the elastic support 69 in the downward direction E2 and disengaged from the second stopper 77.

Through the demounting operation described above, the four developer containers 60Y, 60M, 60C, and 60K are pulled and demounted from the housing portion 71 of the container mount 70 as illustrated in FIGS. 3 and 5.

The mounting/demounting structure 5 may be in the following state when demounting the developer containers 60Y, 60M, 60C, and 60K from the container mount 70.

When demounting the developer containers 60Y, 60M, 60C, and 60K, the first projection 63 of any developer container 60 may first be disengaged from the first stopper 73 and the developer container 60 may be stopped at a tilt in the housing portion 71 of the container mount 70 as illustrated partially in FIG. 10 (without an abutment portion 8 described later). In this state, the developer container 60 is not easily pulled from the housing portion 71 because the second projection 67 of the developer container 60 is not easily disengaged from the second stopper 77.

At this time, the developer container 60 is stopped at a tilt in the housing portion 71 because a deep side of the lower end 61*b* of the body 61, in other words, a corner 61*be* on an upstream side in the pulling direction D2 is in contact with the bottom 71*b* of the housing portion 71 and the second projection 67 is not easily disengaged from the second stopper 77.

The developer container 60 is tilted such that the upper end 61*a* of the body 61 is substantially kept at the mounting position and the lower end 61*b* of the body 61 is located on a downstream side in the pulling direction D2 relative to the upper end 61*a*.

<Details of Mounting/Demounting Structure>

Figure 10:
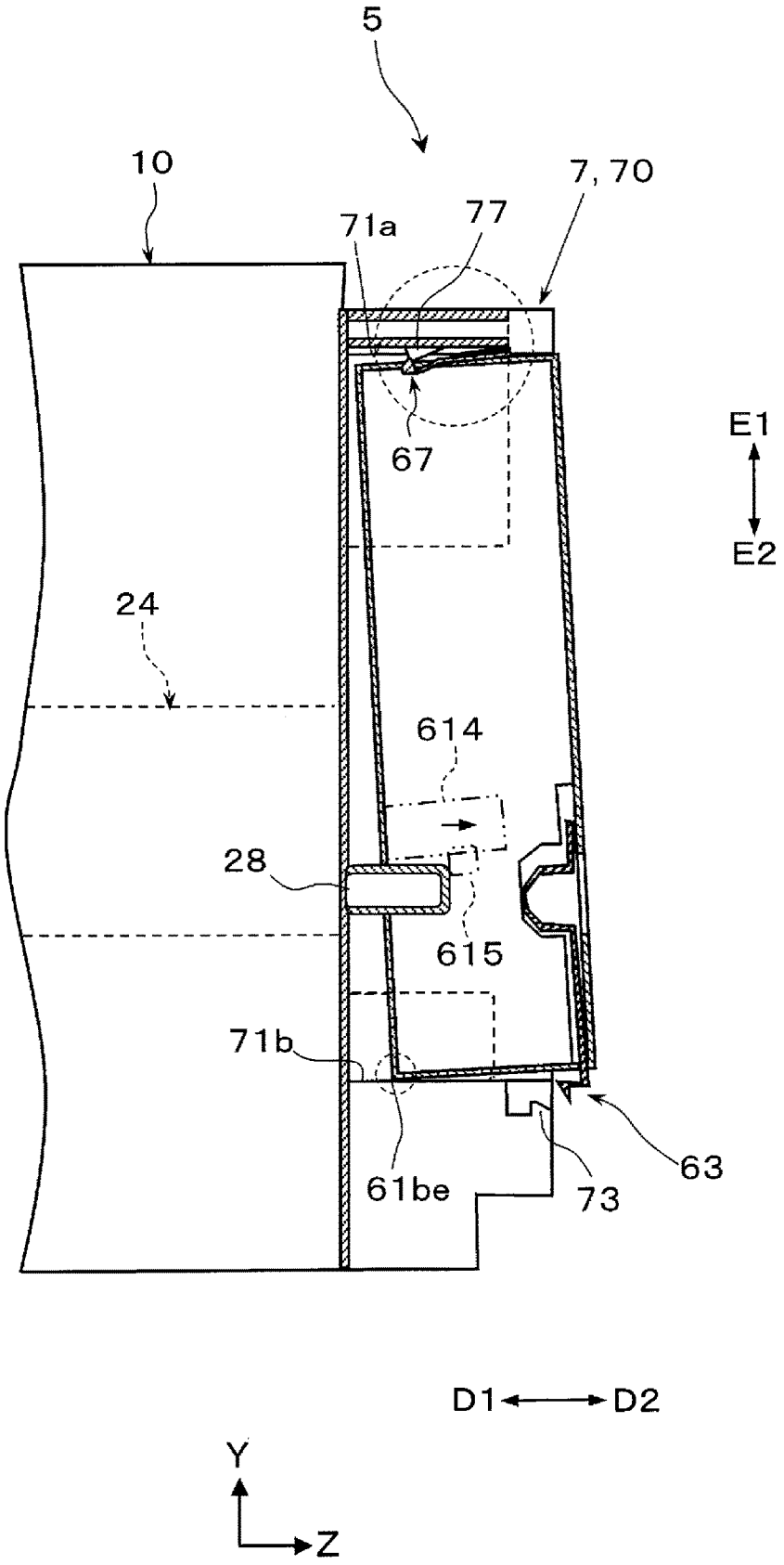
FIG. 10 is a vertical sectional view illustrating how the developer container of FIG. 5 is demounted.

In the mounting/demounting structure 5, the body 61 of the developer container 60 has the abutment portion 8 that abuts against a part of the housing portion 71 to keep a posture reduced in terms of an engagement amount between the second projection 67 and the second stopper 77 as illustrated in FIGS. 7, 10, 11A, and 11B when the first projection 63 is first disengaged from the first stopper 73 and the developer container 60 is stopped at a tilt in the housing portion 71 of the container mount 70 as illustrated in FIG. 10.

As illustrated in FIGS. 4, 5, and 7, the abutment portion 8 of the first exemplary embodiment is provided on the surface of the upper end 61*a* of the body 61 of the developer container 60 as a guide protrusion 81A, 81B that guides the developer container 60 along the inserting and pulling directions D1 and D2 when inserting or pulling the developer container 60.

As illustrated in FIG. 4, the guide protrusion 81A, 81B that is an example of the abutment portion 8 includes left and right guide protrusions 81A and 81B arranged side by side away from each other in a direction orthogonal to the inserting and pulling directions D1 and D2 across the second projection 67.

The left and right guide protrusions 81A and 81B are ribs extending along the inserting and pulling directions D1 and D2, and are arranged on an upstream side in the inserting direction D1 relative to the second projection 67 on the surface of the upper end 61*a*.

As illustrated in FIGS. 7 and 9A, a height h1 of the left and right guide protrusions 81A and 81B is set to such a dimension that the left and right guide protrusions 81A and 81B may come into contact with the ceiling 71*a* of the housing portion 71 when the developer container 60 is inserted into the housing portion 71 of the container mount 70. Downstream ends of the left and right guide protrusions 81A and 81B in the inserting direction D1 are slopes (represented by a slope 81Ba of the right guide protrusion 81B) inclined downward to the downstream side.

The left and right guide protrusions 81A and 81B approach or come into contact with the ceiling 71*a* of the housing portion 71 in a partial period in the process of inserting the developer container 60 into or pulling the developer container 60 from the housing portion 71 (first or second half period) to guide the developer container 60 while regulating a position in the height direction when inserting or pulling the developer container 60.

Upstream ends in the inserting direction D1 that are parts of the left and right guide protrusions 81A and 81B (represented by an end 81Be of the right guide protrusion 81B) actually function as the abutment portion 8.

As illustrated in FIG. 7, the upstream ends (81Be) of the guide protrusions 81A and 81B in the inserting direction D1 are provided at positions on an upstream side of the middle of the dimension Ld (Ld/2) along the inserting direction D1 in which the developer container 60 is mounted. Specifically, the ends (81Be) in the first exemplary embodiment are provided at positions near an upstream end 61*ae* of the developer container 60 along the inserting direction D1.

If the abutment portion 8 (the end 81Be of the guide protrusion) is provided at a position on the downstream side of the middle (Ld/2) of the developer container 60, it is difficult to demount the developer container 60 from the housing portion 71 when the developer container 60 is stopped at a tilt in the housing portion 71.

The upstream ends (81Be) of the guide protrusions 81A and 81B may have such lengths along the inserting and pulling directions D1 and D2 that the ends remain in contact with a part of the housing portion 71 until the second projection 67 climbs over and disengage from the second stopper 77 when demounting the developer container 60.

In the mounting/demounting structure 5, the protrusion 68 of the second projection 67 is provided at the position on the downstream side of the middle of the dimension Ld (Ld/2) along the inserting direction D1 in which the developer container 60 is mounted in relation to the position of the abutment portion 8 as illustrated in FIG. 7.

In the mounting/demounting structure 5, as in an enlarged part of FIG. 7, the rising surface 68*a* of the protrusion 68 of the second projection 67 of the developer container 60 is a slope inclined at an appropriate inclination angle α toward the upstream side in the pulling direction D2 of the developer container 60. In FIG. 7, a two-dot chain line Lv is a normal to the inserting and pulling directions D1 and D2 of the developer container 60.

In the mounting/demounting structure 5, as in an enlarged part of FIG. 8, at least a lower part of the downward surface 77*a* of the second stopper 77 of the container mount 70 is a slope inclined at an appropriate inclination angle β toward the downstream side in the pulling direction D2 of the developer container 60 in relation to the slope of the rising surface 68*a* of the second projection 67. The inclination angle β is set substantially equal to the inclination angle α of the rising surface 68*a* of the second projection 67 of the developer container 60. In FIG. 8, a two-dot chain line Lv is a normal to the horizontal ceiling 71*a*.

Figure 11A:
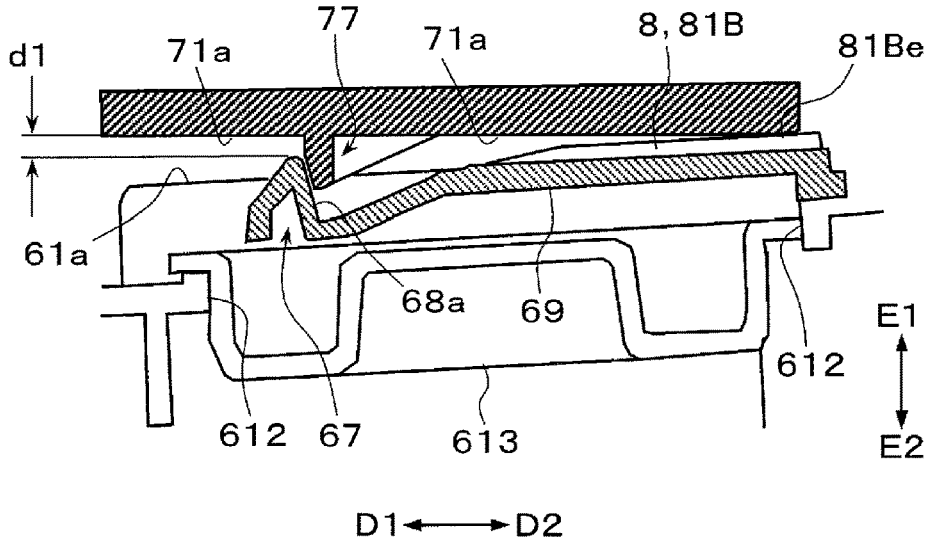
FIG. 11A illustrates a principal part in the state of FIG. 10.
Figure 11B:
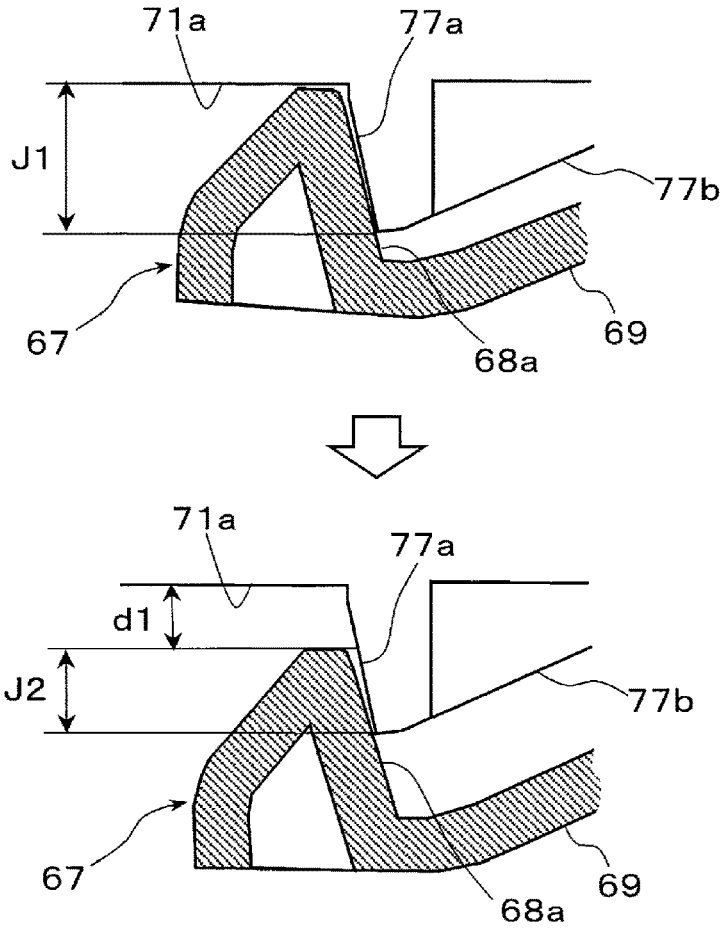
FIG. 11B illustrates a decrease in an engagement amount of a second projection.

In the mounting/demounting structure 5 including the abutment portion 8, when the first projection 63 of any developer container 60 is first disengaged from the first stopper 73 and the developer container 60 is stopped at a tilt in the housing portion 71 of the container mount 70 as illustrated in FIG. 10 during demounting of the developer containers 60Y, 60M, 60C, and 60K, the abutment portion 8 (the end 81Be of the guide protrusion 81B) of the developer container 60 abuts against the ceiling 71*a* that is an example of a part of the housing portion 71 as illustrated in FIGS. 10, 11A, and 11B.

As illustrated in FIGS. 11A and 11B, the entire developer container 60 including the second projection 67 descends by, for example, a distance d1 in the downward direction E2 from the mounting position (illustrated in an upper part of FIG. 11B) in response to the abutment of the abutment portion 8 (the end 81Be of the guide protrusion 81B) against the ceiling 71*a* of the housing portion 71.

Figure 13A:
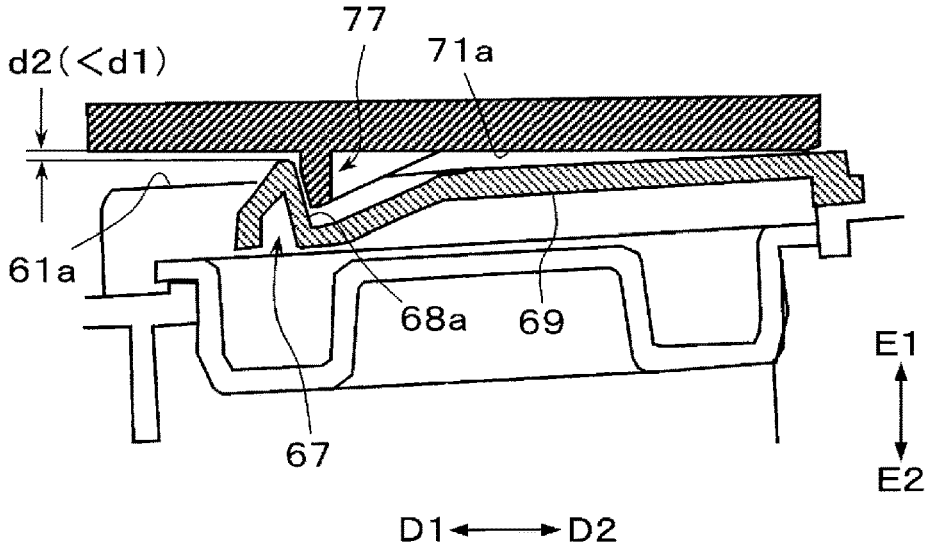
FIG. 13A is a schematic sectional view illustrating an upper part of a developer container of a comparative example in the state of FIG. 10.
Figure 13B:
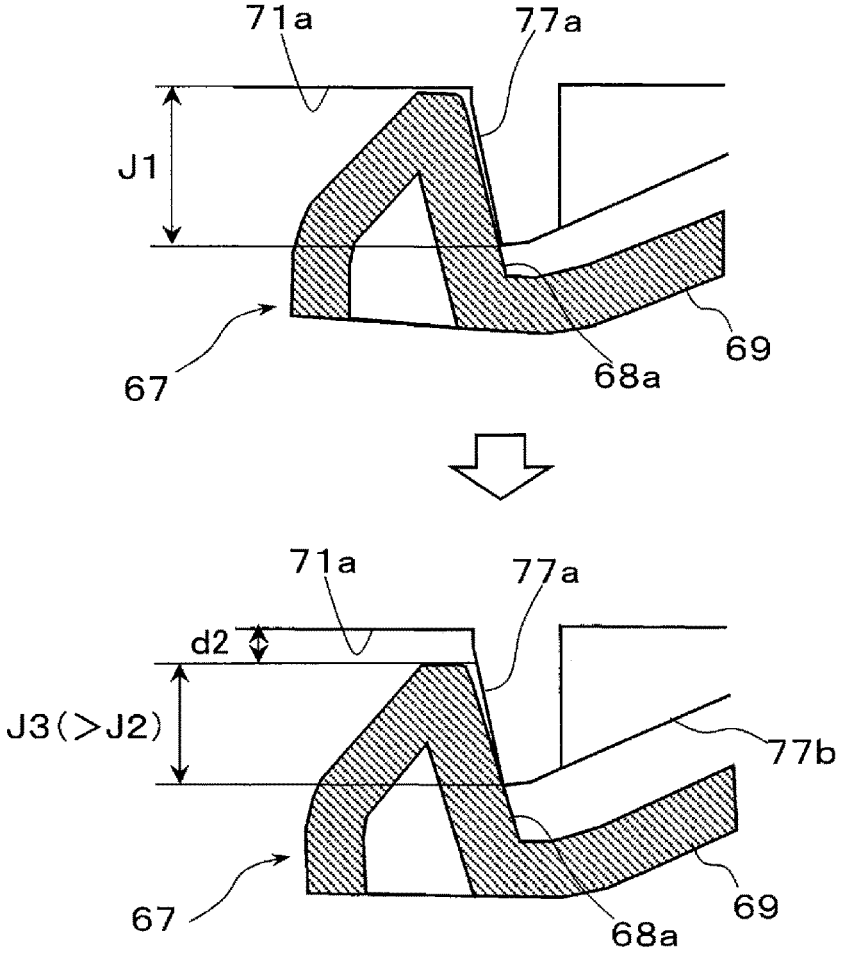
FIG. 13B illustrates a decrease in an engagement amount of a second projection of the developer container of the comparative example.

In a developer container 60 without the abutment portion 8, as illustrated in FIG. 13A, the entire developer container 60 including the second projection 67 descends by a distance d2 in the downward direction E2 from the mounting position (illustrated in an upper part of FIG. 13B). The distance d2 is smaller than the distance d1 (d2<d1) by an amount corresponding to the absence of the abutment portion 8 (corresponding substantially to the height h1 of the abutment portion 8).

In the developer container 60 according to the first exemplary embodiment, the second projection 67 descends substantially by the same distance d1 in the downward direction E2 as illustrated in FIG. 11B. Therefore, an engagement amount J2 between the second projection 67 and the second stopper 77 (downward surface 77*a*) is smaller than an engagement amount J1 between the second projection 67 and the second stopper 77 when (at the position where) the developer container 60 is mounted (J2<J1). In other words, the lower end of the downward surface 77*a* of the second stopper 77 that faces the rising surface 68*a* of the second projection 67 in contact is shifted upward from the root of the rising surface 68*a* of the second projection 67 (boundary with the elastic support 69) as illustrated in FIG. 11B.

The decrease in the engagement amount J2 between the second projection 67 and the second stopper 77 may also be achieved by turning the developer container 60 (upper end 61*a*) counterclockwise in FIG. 11A about a point where the abutment portion 8 abuts against the ceiling 71*a*.

At this time, the developer container 60 is easily turned by providing the abutment portion 8 (the end 81Be of the guide protrusion) on the upper end 61*a* of the body 61 of the developer container 60 at the position on the downstream side in the inserting direction D1, or providing the second projection 67 on the upper end 61*a* of the body 61 of the developer container 60 at the position on the downstream side in the inserting direction D1.

In the developer container 60 without the abutment portion 8, the second projection 67 descends substantially by the same distance d2 in the downward direction E2 as illustrated in FIG. 13B. However, an engagement amount J3 between the second projection 67 and the second stopper 77 (downward surface 77*a*) is slightly smaller than the engagement amount J1 between the second projection 67 and the second stopper 77 when (at the position where) the developer container 60 is mounted. The engagement amount J3 is larger than the engagement amount J2 between the second projection 67 and the second stopper 77 in the developer container 60 according to the first exemplary embodiment (J1>J3>J2).

Figure 12A:
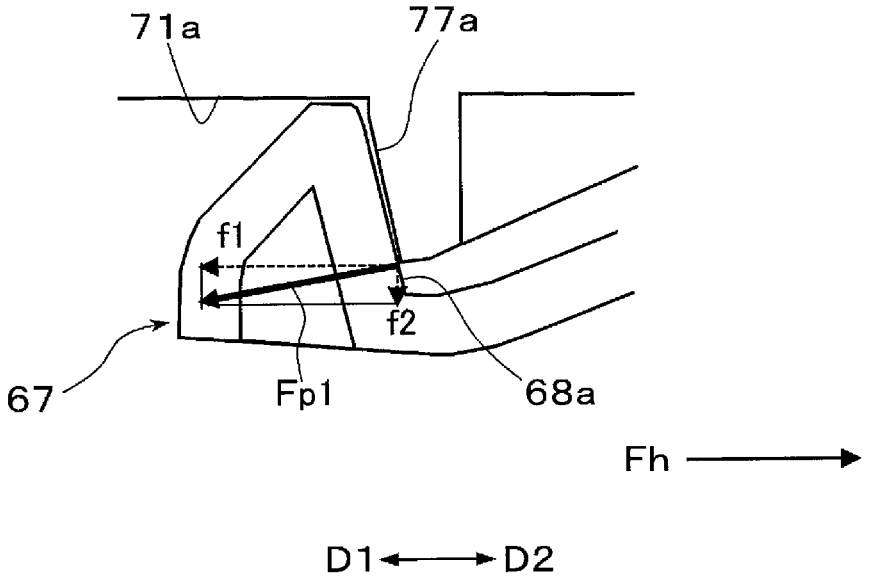
FIG. 12A illustrates the second projection when the developer container is mounted.
Figure 12B:
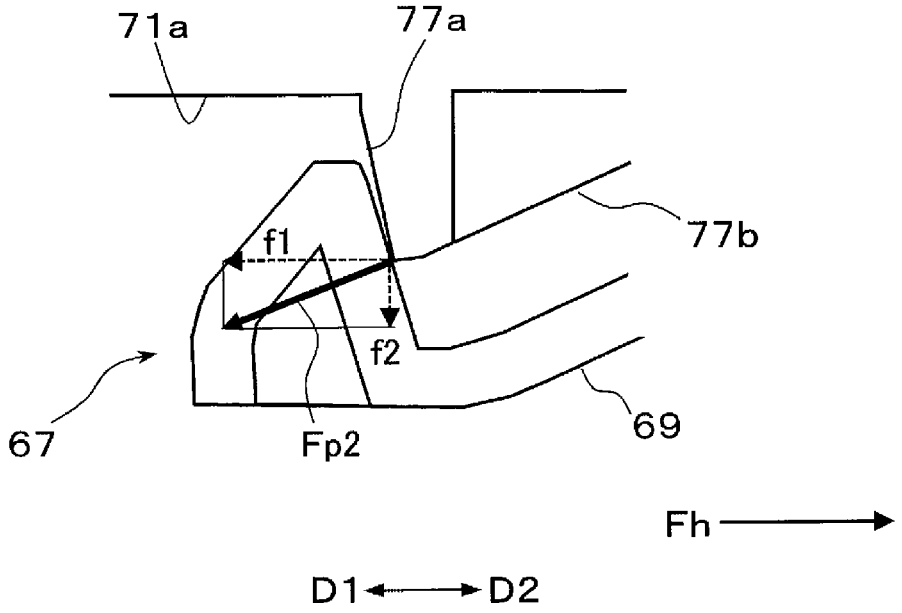
FIG. 12B illustrates the second projection in the state of FIG. 10.

In the mounting/demounting structure 5, when the developer container 60 is stopped at a tilt in the housing portion 71 of the container mount 70 for the reason described above, the developer container 60 is pulled by a pulling force Fh in the pulling direction D2 as illustrated in FIGS. 12A and 12B. A direction of a force (reaction force) Fp2 received by the second projection 67 from the second stopper 77 due to the pulling force Fh is slightly downward compared with a direction of a force (reaction force) Fp1 when the developer container 60 is mounted (FIG. 12A) or when the abutment portion 8 is not provided. A horizontal component force f1 of the reaction force Fp2 decreases and a vertical component force f2 of the reaction force Fp2 increases. The vertical component force f2 is a downward force corresponding to a force in a direction in which the second projection 67 is shifted downward and disengages from the second stopper 77.

Second Exemplary Embodiment

Figure 14:
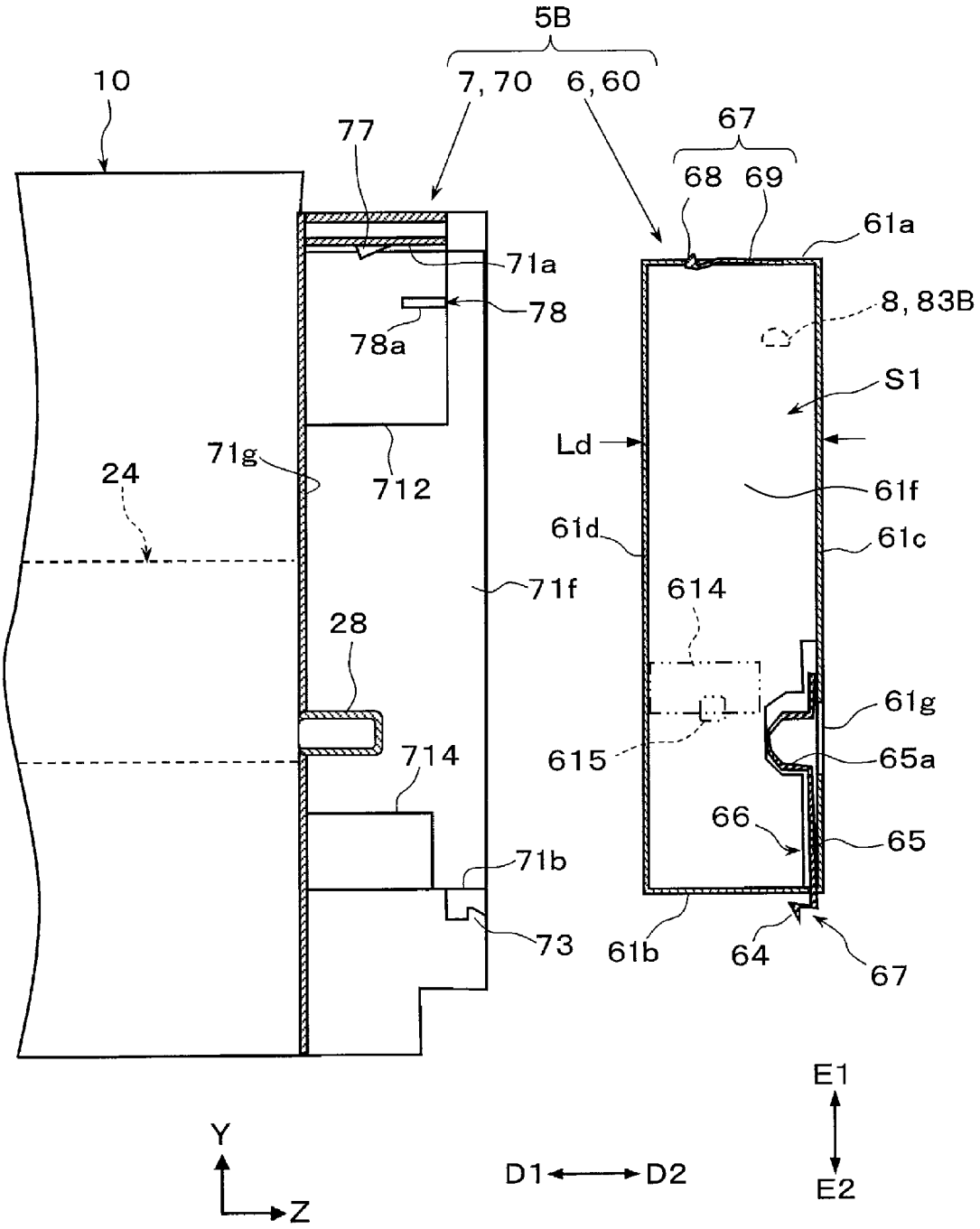
FIG. 14 is a vertical sectional view illustrating a developer container and a container mount in a mounting/demounting structure according to a second exemplary embodiment.

FIG. 14 illustrates a mounting/demounting structure 5B according to a second exemplary embodiment.

The mounting/demounting structure 5B is identical to the mounting/demounting structure 5 according to the first exemplary embodiment except that the abutment portion 8 provided on the body 61 of the developer container 60 is changed to a protrusion 83A, 83B.

In the following description, components in common with the mounting/demounting structure 5 according to the first exemplary embodiment are represented by the same reference symbols to omit their description unless otherwise needed. The same applies to description of a third exemplary embodiment and other subsequent description.

As illustrated in FIGS. 4 and 14, the abutment portion 8 of the second exemplary embodiment includes left and right protrusions 83A and 83B symmetrically provided at upper parts (near the upper end 61*a*) of the left side 61*e* and the right side 61*f* of the body 61 of the developer container 60, respectively.

The left and right protrusions 83A and 83B substantially horizontally protrude outward from the left side 61*e* and the right side 61*f*, respectively, and the upper surfaces are arc surfaces. The protrusions 83A and 83B are provided at positions on the upstream side of the middle of the dimension Ld (Ld/2) along the inserting direction D1 in which the developer container 60 is mounted.

In the mounting/demounting structure 5B, the housing portion 71 of the container mount 70 includes abutment portion receivers 78 where the protrusions 83A and 83B abut as the abutment portion 8 when the developer container 60 is stopped at a tilt in the housing portion 71 for the reason described above during the demounting (FIG. 16).

The abutment portion receivers 78 are protruding threads (ribs) extending along the inserting and pulling directions D1 and D2 of the developer container 60 by appropriate lengths. The abutment portion receivers 78 are provided on the left wall 71*e*, the three upper partition plates 712, and the right wall 71*f* in the housing portion 71 at equal-height positions to face each other so that the left and right abutment portion receivers 78 are paired in each of the four housing spaces defined in the housing portion 71. Lower surfaces 78*a* of the abutment portion receivers 78 where the protrusions 83A and 83B abut are set at such height positions that the protrusions 83A and 83B may approach or come into contact with the lower surfaces 78*a* from a lower side when the developer container 60 is mounted by being pushed in the inserting direction D1.

In the mounting/demounting structure 5B, the developer containers 60Y, 60M, 60C, and 60K are mounted on the container mount 70 by a mounting operation similar to that in the mounting/demounting structure 5 according to the first exemplary embodiment.

Figure 15:
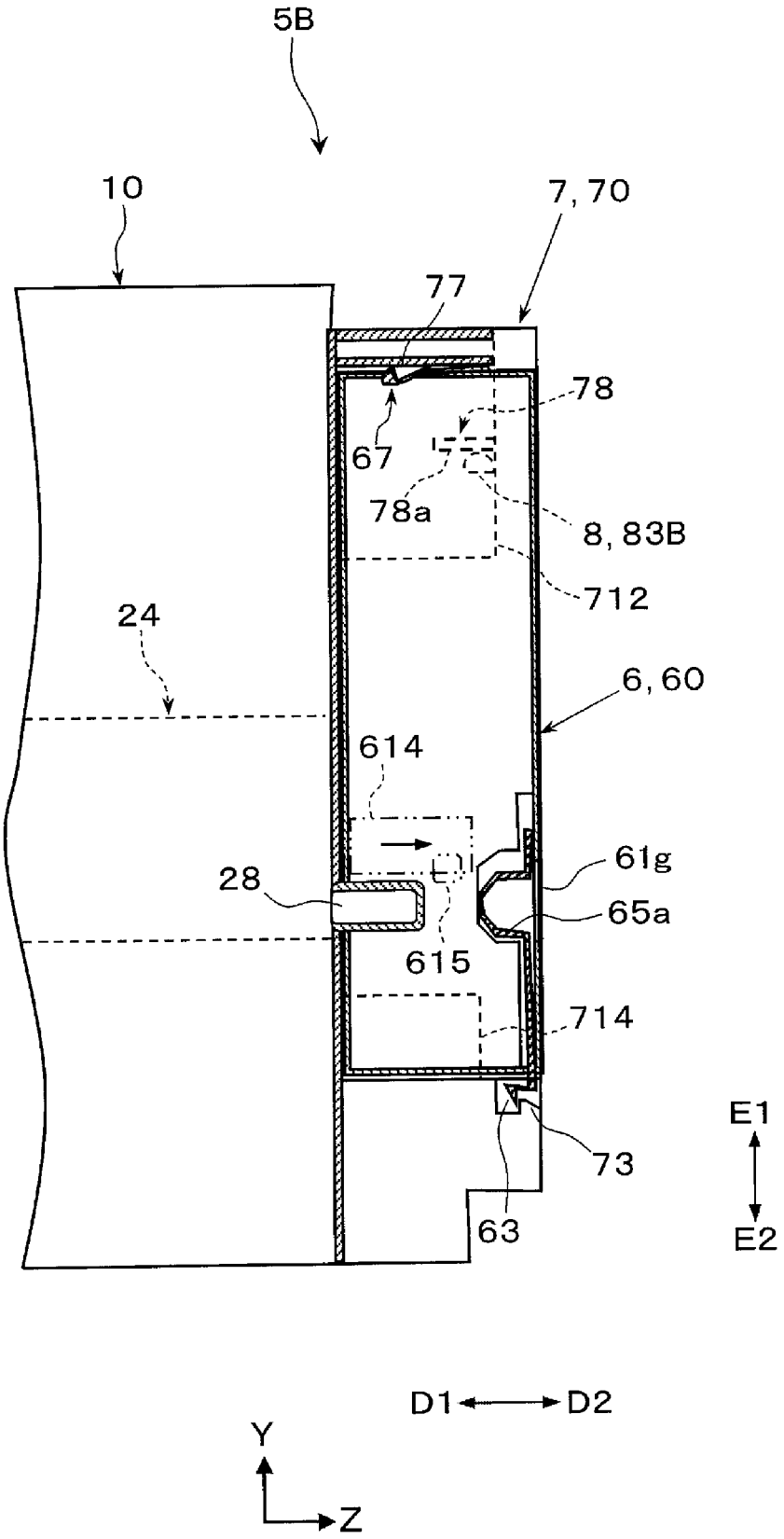
FIG. 15 is a vertical sectional view illustrating the developer container of FIG. 14 mounted on the container mount.

Also in the mounting/demounting structure 5B, as illustrated in FIG. 15, the mounting is completed when the first projection 63 of the developer container 60 is stopped by engagement with the first stopper 73 of the container mount 70 and the second projection 67 is stopped by engagement with the second stopper 77 of the container mount 70.

In the second half of the mounting process, the protrusions 83A and 83B serving as the abutment portion 8 of the developer container 60 approach or come into contact with the lower surfaces 78*a* of the abutment portion receivers 78 of the housing portion 71.

In the mounting/demounting structure 5B, the developer containers 60Y, 60M, 60C, and 60K are demounted from the container mount 70 by a demounting operation similar to that in the mounting/demounting structure 5 according to the first exemplary embodiment.

Also in the mounting/demounting structure 5B, the developer container 60 is demounted by being pulled along the pulling direction D2 from the housing portion 71 of the container mount 70 while the bent manipulator 65*a* of the support 65 of the first projection 63 is lifted in the upward direction E1.

At this time, the developer container 60 may be pulled because the protrusion 64 of the first projection 63 is disengaged from the first stopper 73. At the start of movement of the developer container 60 in the pulling direction D2, the protrusion 68 of the second projection 67 is shifted downward and disengaged from the second stopper 77. Thus, the developer container 60 is pulled.

In the first half of the demounting process, the protrusions 83A and 83B serving as the abutment portion 8 of the developer container 60 approach or come into contact with the lower surfaces 78*a* of the abutment portion receivers 78 of the housing portion 71.

Figure 16:
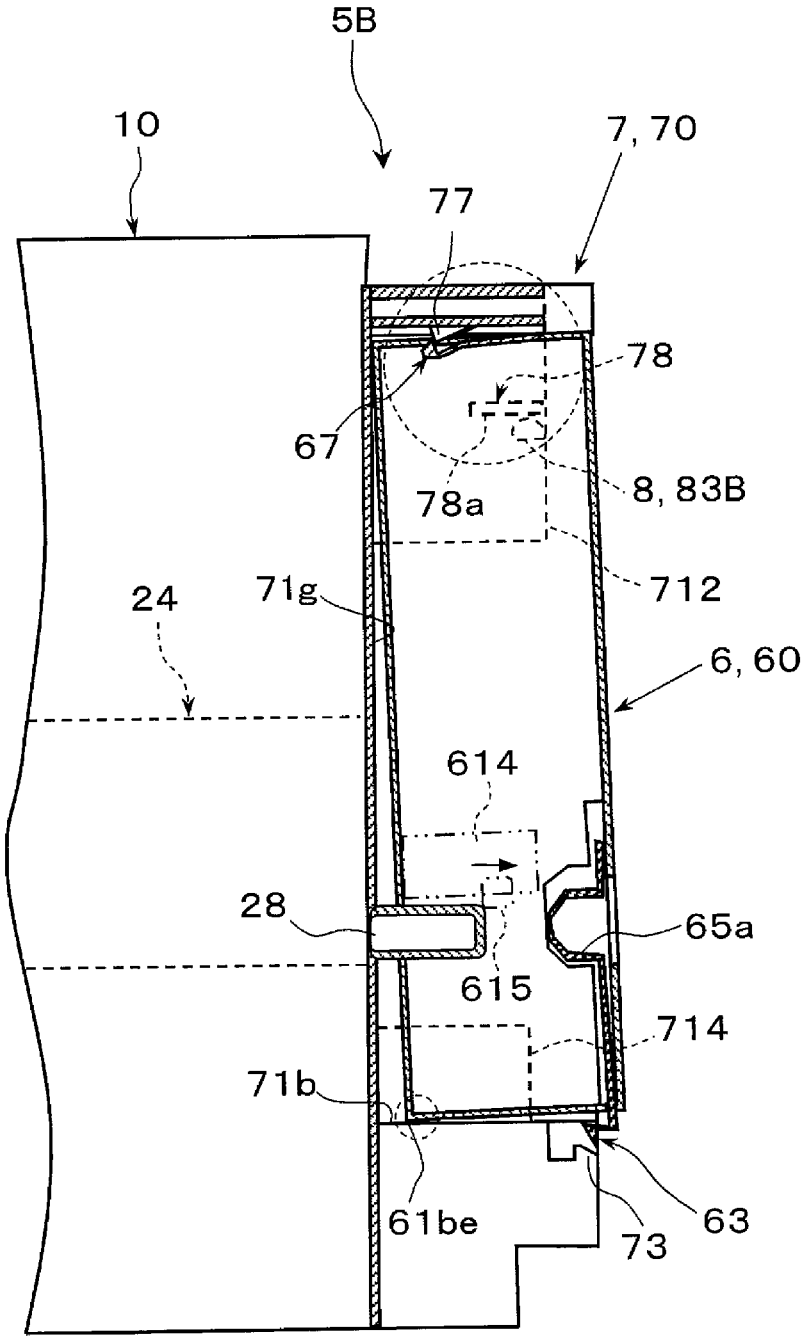
FIG. 16 is a vertical sectional view illustrating how the developer container of FIG. 14 is demounted.
Figure 17:
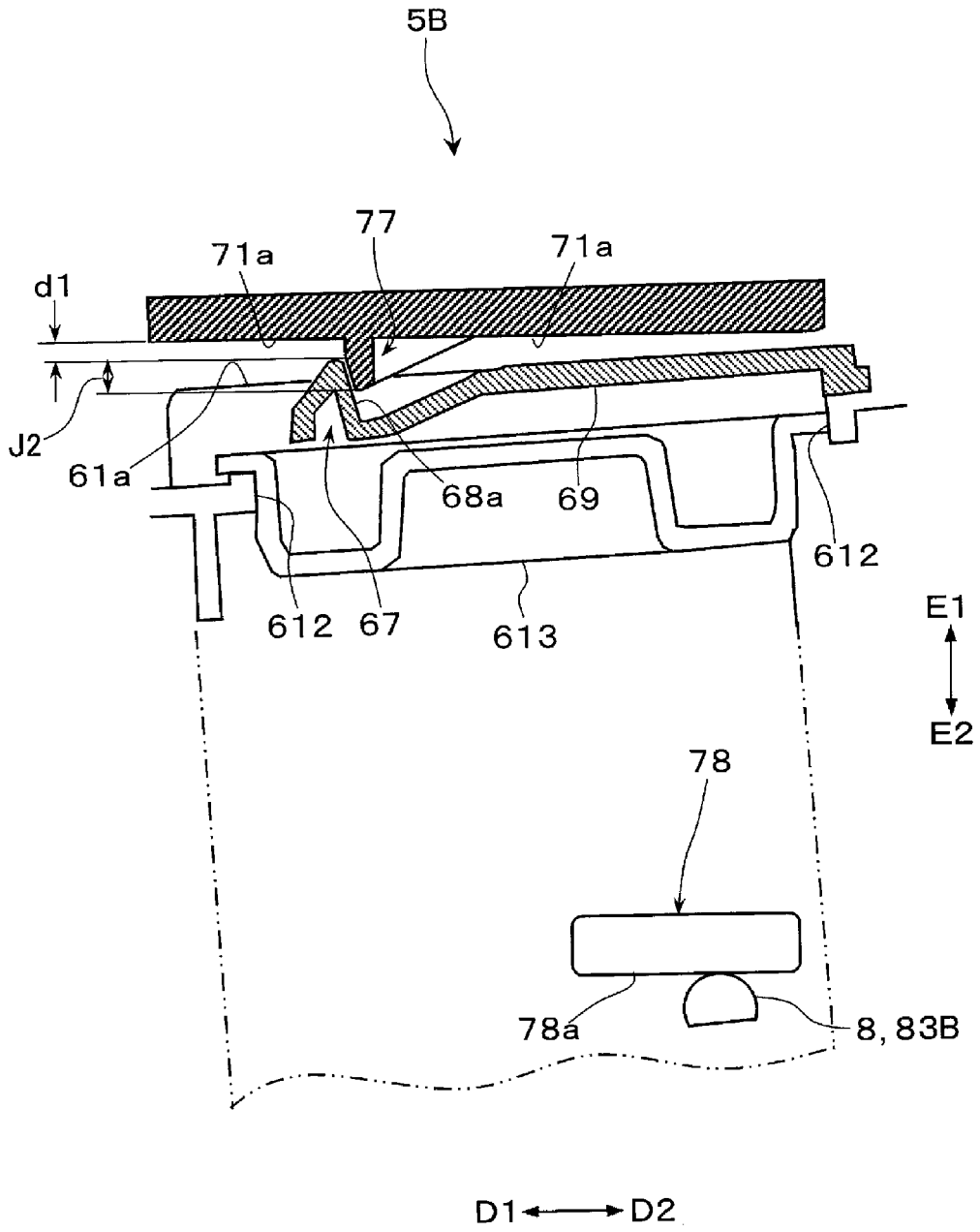
FIG. 17 illustrates a principal part in the state of FIG. 16.

Also in the mounting/demounting structure 5B including the abutment portion 8 that is each of the protrusions 83A and 83B, when the first projection 63 of any developer container 60 is first disengaged from the first stopper 73 and the developer container 60 is stopped at a tilt in the housing portion 71 of the container mount 70 as illustrated in FIG. 16 during demounting of the developer containers 60Y, 60M, 60C, and 60K, the abutment portion 8 (represented by the right protrusion 83B in the figures) of the developer container 60 abuts against the lower surface 78*a* of the abutment portion receiver 78 that is an example of a part of the housing portion 71 as illustrated in FIGS. 16 and 17.

As illustrated in FIG. 17, the developer container 60 keeps a posture reduced in terms of the engagement amount between the second projection 67 and the second stopper 77 (e.g., reduced from J1 (mounted) to J2) similarly to the mounting/demounting structure 5 according to the first exemplary embodiment (see FIG. 11B).

Third Exemplary Embodiment

Figure 18:
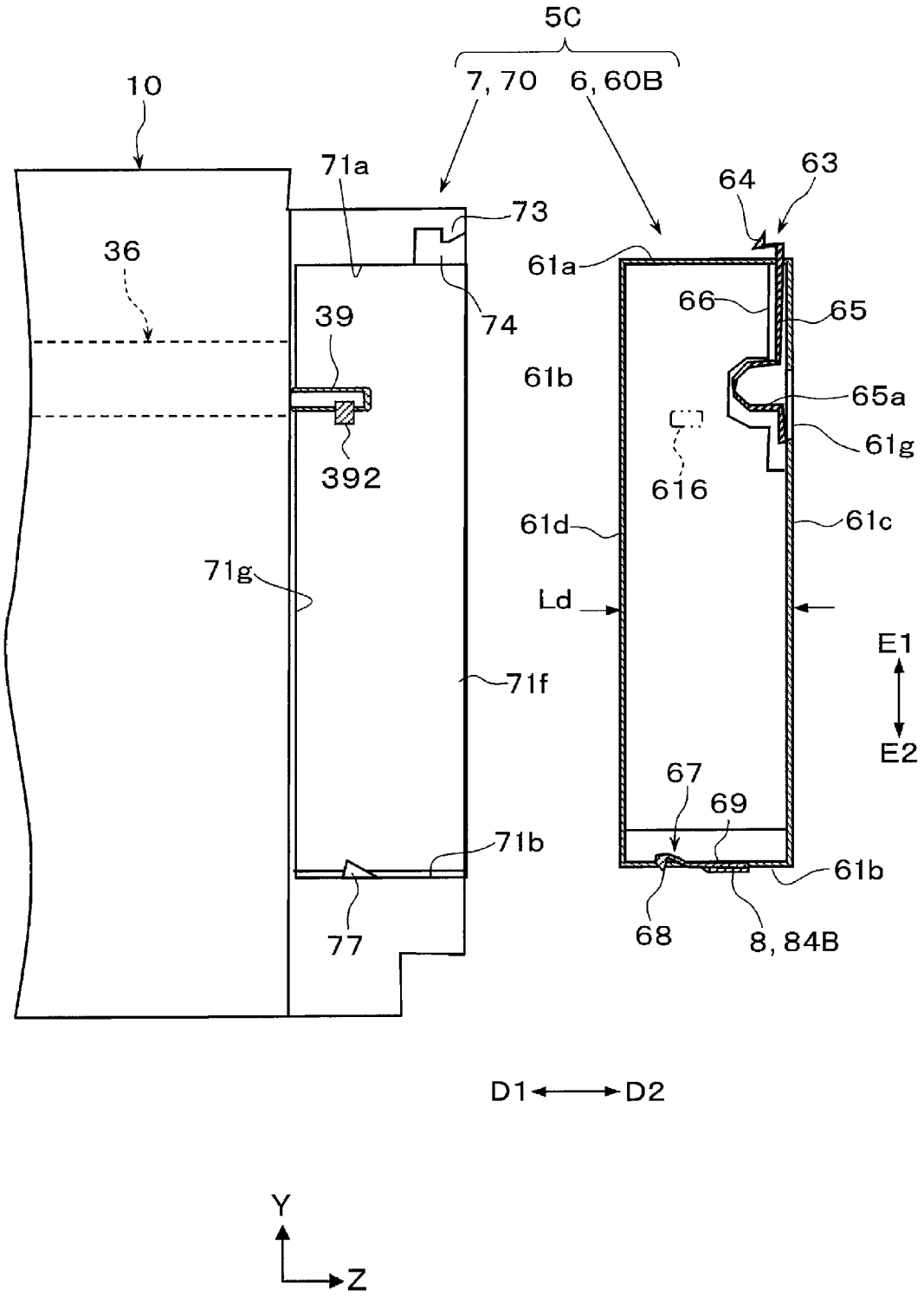
FIG. 18 is a vertical sectional view illustrating a developer container and a container mount in a mounting/demounting structure according to a third exemplary embodiment.

FIG. 18 illustrates a mounting/demounting structure 5C according to a third exemplary embodiment.

The mounting/demounting structure 5C is identical to the mounting/demounting structure 5 according to the first exemplary embodiment except that the first projection 63 and the second projection 67 provided on the body 61 of the developer container 60 are inverted, the first stopper 73 and the second stopper 77 provided on the housing portion 71 of the container mount 70 are inverted along with the inversion of the first projection 63 and the second projection 67, and the developer container 60 is changed to a collecting container 60B.

In the mounting/demounting structure 5C, the collecting container 60B is a single container that collects a collection target including waste such as the developer removed by the second cleaner 36 of the image former 2A.

The collecting container 60B includes the container-shaped body 61 that contains the collection target such as the developer to be collected, the first projection 63 provided at one end of the body 61 to move in the vertical direction, and the second projection 67 provided at the other end of the body 61 to shift in the vertical direction by elasticity.

The body 61 has substantially the same structure as the body 61 of the developer container 60 in the first exemplary embodiment (FIG. 4).

The body 61 has, at its upper part, a contact portion 616 that comes into contact with an open/close lid 392 when mounting the collecting container 60B. The open/close lid 392 opens or closes an outlet of a dispenser 39 described later. When mounting the collecting container 60B, the contact portion 616 comes into contact with the open/close lid 392 to open the outlet.

The first projection 63 is provided at the upper end 61*a* that is another example of the one end of the body 61 to move in the upward and downward directions E1 and E2. The first projection 63 has substantially the same structure as the first projection 63 of the developer container 60 in the first exemplary embodiment.

The second projection 67 is provided at the lower end 61*b* that is another example of the other end of the body 61 to shift in the upward and downward directions E1 and E2. The second projection 67 has substantially the same structure as the second projection 67 of the developer container 60 in the first exemplary embodiment.

In this case, the upper and lower sides and the orientations of the components of the first projection 63 and the second projection 67 are inverted compared with the upper and lower sides and the orientations of the components of the first projection 63 and the second projection 67 described in the first exemplary embodiment.

The container mount 70 in the mounting/demounting structure 5C includes the housing portion 71 where the single collecting container 60B is mounted or demounted by inserting or pulling the collecting container 60B, the first stopper 73 that is provided in the housing portion 71 and stops the first projection 63 by engagement, and the second stopper 77 that is provided in the housing portion 71 and stops the second projection 67 by engagement.

The housing portion 71 has substantially the same structure as the housing portion 71 in the first exemplary embodiment except that the three upper partition plates 712 and the three lower partition plates 714 in the first exemplary embodiment are not provided.

As illustrated in FIGS. 3 and 18, the housing portion 71 includes the dispenser 39 protruding from the back wall 71*g*. The dispenser 39 transports the collection target such as the developer from the second cleaner 36. The dispenser 39 has the open/close lid 392 movable in directions along the inserting and pulling directions D1 and D2 in which the collecting container 60B is inserted and pulled to open or close the outlet (not illustrated) where the collection target is sent. The open/close lid 392 is urged in the pulling direction D2 by an urging member such as a coil spring (not illustrated) to stay at an outlet closing position unless an external force is applied.

The first stopper 73 is provided at the ceiling 71*a* of the housing portion 71. The first stopper 73 has substantially the same structure as the first stopper 73 of the container mount 70 in the first exemplary embodiment.

The second stopper 77 is provided at the bottom 71*b* of the housing portion 71. The second stopper 77 has substantially the same structure as the second stopper 77 of the container mount 70 in the first exemplary embodiment.

Also in this case, the upper and lower sides and the inclination directions of the components of the first stopper 73 and the second stopper 77 are inverted compared with the upper and lower sides and the inclination directions of the components of the first stopper 73 and the second stopper 77 described in the first exemplary embodiment.

Figure 20:
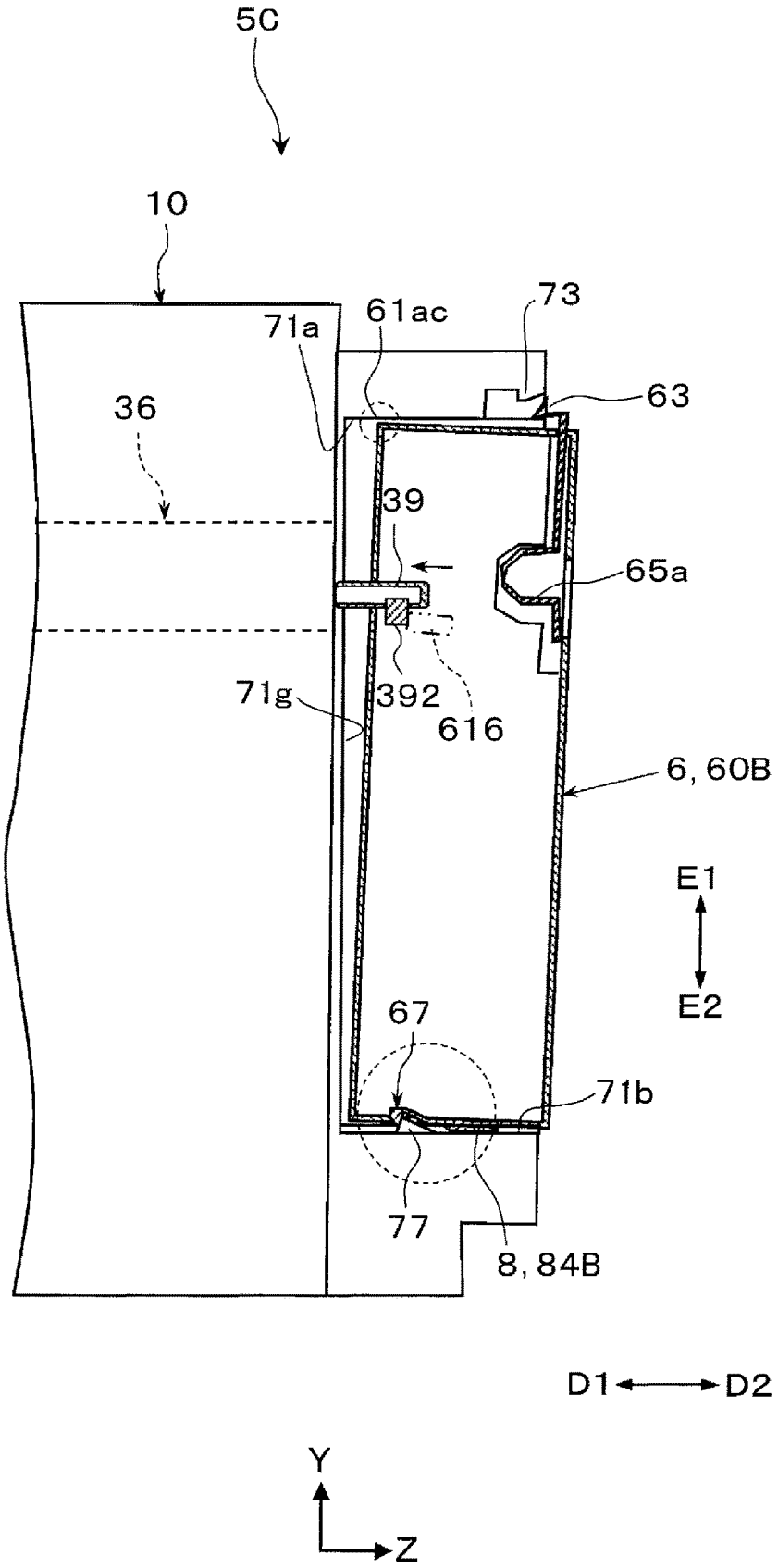
FIG. 20 is a vertical sectional view illustrating how the developer container of FIG. 18 is demounted.
Figure 21:
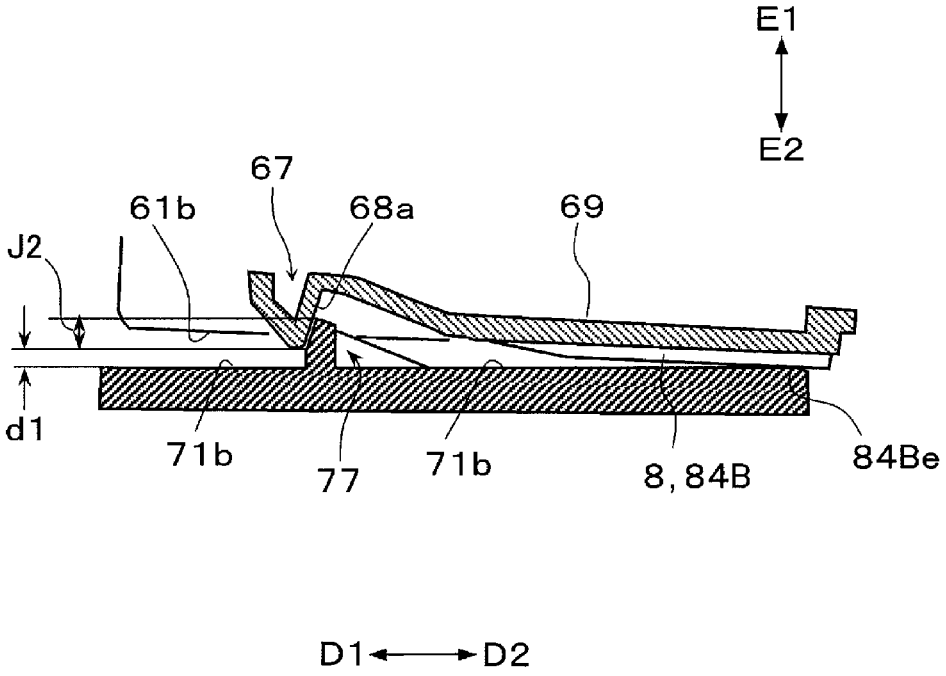
FIG. 21 illustrates a principal part in the state of FIG. 20.

In the mounting/demounting structure 5C, the body 61 of the collecting container 60B has, at the lower end 61*b*, the abutment portion 8 that abuts against the bottom 71*b* that is a part of the housing portion 71 to keep a posture reduced in terms of the engagement amount between the second projection 67 and the second stopper 77 as illustrated in FIGS. 20 and 21 when the first projection 63 is first disengaged from the first stopper 73 and the collecting container 60B is stopped at a tilt in the housing portion 71 of the container mount 70 as illustrated in FIG. 20.

The collecting container 60B is tilted when stopped such that the lower end 61*b* of the body 61 is substantially kept at the mounting position and the upper end 61*a* of the body 61 is located on a downstream side in the pulling direction D2 relative to the lower end 61*b*. In the collecting container 60B stopped at a tilt, a deep side of the upper end 61*a* of the body 61, in other words, a corner 61*ac* on an upstream side in the pulling direction D2 is in contact with the ceiling 71*a* of the housing portion 71.

Similarly to the left and right guide protrusions 81A and 81B serving as the abutment portion 8 in the first exemplary embodiment (see FIG. 4), the abutment portion 8 in the third exemplary embodiment includes left and right guide protrusions (represented by the right guide protrusion 84B in the figures) arranged side by side away from each other in a direction orthogonal to the inserting and pulling directions D1 and D2 across the second projection 67 in the lower end 61*b* of the body 61. The left and right guide protrusions are hereinafter referred to simply as "left and right guide protrusions".

Also in this case, the upper and lower sides of the components of the left and right guide protrusions are inverted compared with the upper and lower sides of the components of the left and right guide protrusions 81A and 81B described in the first exemplary embodiment.

A height of the left and right guide protrusions is set to such a dimension that the left and right guide protrusions come into contact with the bottom 71*b* of the housing portion 71 when the collecting container 60B is inserted into the housing portion 71 of the container mount 70. Upstream ends in the inserting direction D1 that are parts of the left and right guide protrusions (represented by an end 84Be of the right guide protrusion 84B) actually function as the abutment portion 8.

The other structures of the left and right guide protrusions are identical to the structures of the left and right guide protrusions 81A and 81B in the first exemplary embodiment. The left and right guide protrusions come into contact with the bottom 71*b* of the housing portion 71 in a partial period in the process of inserting the collecting container 60B into or pulling the collecting container 60B from the housing portion 71 to guide the collecting container 60B while temporarily regulating a position in the height direction when inserting or pulling the collecting container 60B.

In the mounting/demounting structure 5C, the collecting container 60B is mounted on the container mount 70 by a mounting operation substantially similar to that in the mounting/demounting structure 5 according to the first exemplary embodiment (except for the difference that a part of the components functions in an inverted posture).

Figure 19:
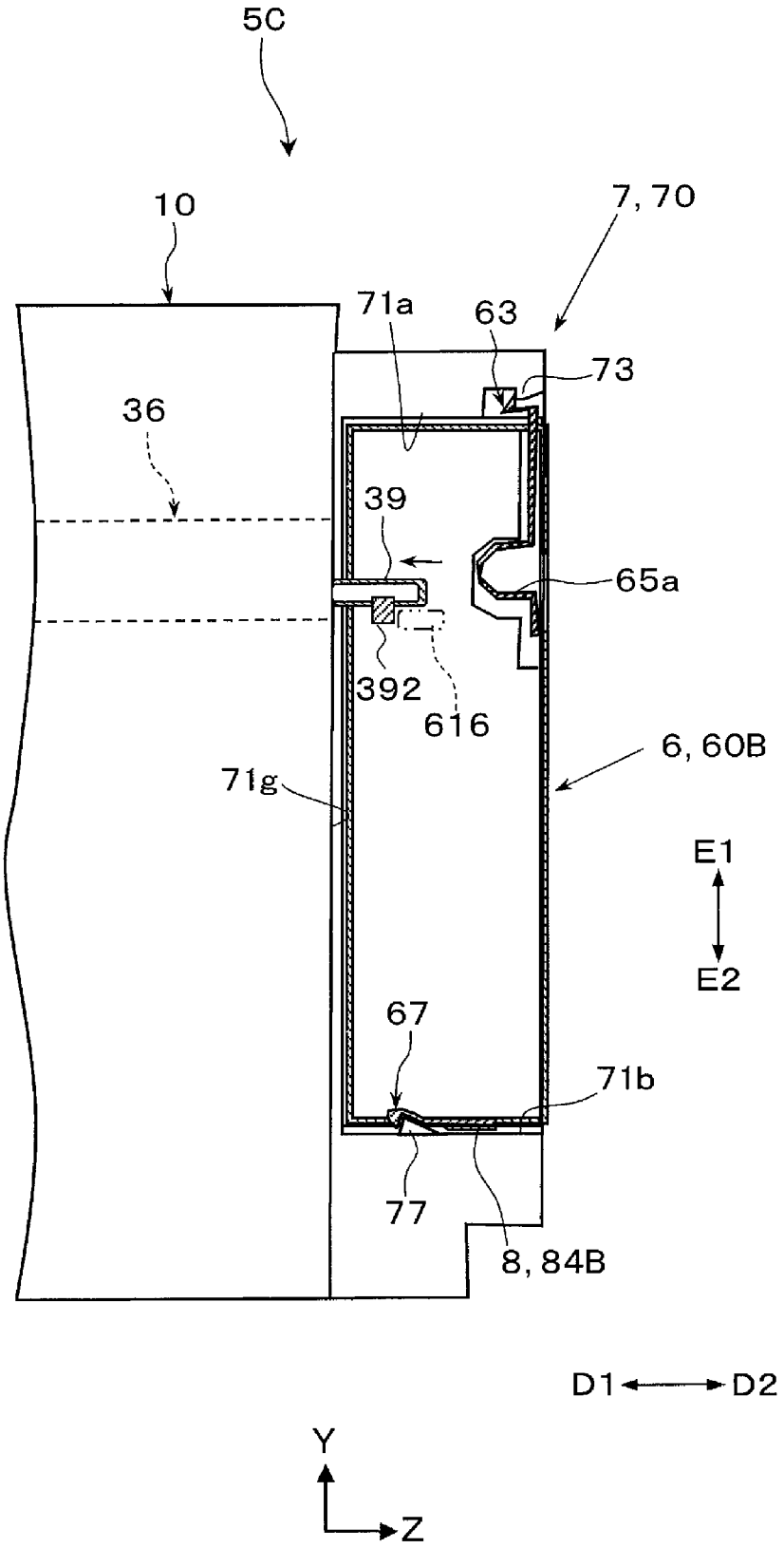
FIG. 19 is a vertical sectional view illustrating the developer container of FIG. 18 mounted on the container mount.

Also in the mounting/demounting structure 5C, as illustrated in FIG. 19, the mounting is completed when the first projection 63 of the collecting container 60B is stopped by engagement with the first stopper 73 of the container mount 70 and the second projection 67 is stopped by engagement with the second stopper 77 of the container mount 70.

In the second half of the mounting process, the left and right guide protrusions serving as the abutment portion 8 of the collecting container 60B come into sliding contact with the bottom 71*b* of the housing portion 71.

In the mounting, the engagement of the first projection 63 with the first stopper 73 and the engagement of the second projection 67 with the second stopper 77 occur substantially at the same timing.

When the collecting container 60B is mounted on the housing portion 71 of the container mount 70, the open/close lid 392 of the dispenser 39 of the housing portion 71 comes into contact with the contact portion 616 of the collecting container 60B, and is pushed toward a downstream side in the inserting direction D1 against an urging force of the urging member (not illustrated), thereby opening the outlet of the dispenser 39. Thus, the collecting container 60B is connected to the dispenser 39 of the housing portion 71 and the collection target such as the developer sent from the second cleaner 36 is collectable.

The mounted collecting container 60B remains pushed in the pulling direction D2 because of a reaction force against the urging force of the urging member. When the mounting of the collecting container 60B is completed, the downward surface 64*b* of the first projection 63 is pushed against the vertical surface 75*a* of the protrusion 75 of the first stopper 73 by the reaction force to stabilize the engagement of the first projection 63 with the first stopper 73.

In the mounting/demounting structure 5C, the collecting container 60B is demounted from the container mount 70 by a demounting operation substantially similar to that in the mounting/demounting structure 5 according to the first exemplary embodiment (except for the difference that a part of the components functions in an inverted posture).

In the mounting/demounting structure 5C, the collecting container 60B is demounted by being pulled along the pulling direction D2 from the housing portion 71 of the container mount 70 while the bent manipulator 65*a* of the support 65 of the first projection 63 is depressed in the downward direction E2.

At this time, the collecting container 60B may be pulled because the protrusion 64 of the first projection 63 is disengaged from the first stopper 73. At the start of movement of the collecting container 60B in the pulling direction D2, the protrusion 68 of the second projection 67 is shifted upward and disengaged from the second stopper 77. Thus, the collecting container 60B is pulled.

In the first half of the demounting process, the left and right guide protrusions serving as the abutment portion 8 of the collecting container 60B come into sliding contact with the bottom 71*b* of the housing portion 71.

In the mounting/demounting structure 5C including the abutment portion 8 that is each of the left and right guide protrusions, when the first projection 63 is first disengaged from the first stopper 73 and the collecting container 60B is stopped at a tilt in the housing portion 71 of the container mount 70 as illustrated in FIG. 20 during demounting of the collecting container 60B, the abutment portion 8 (represented by the end 84Be of the right guide protrusion 84B in the figures) of the collecting container 60B abuts against the bottom 71*b* that is an example of a part of the housing portion 71 as illustrated in FIGS. 20 and 21.

As illustrated in FIG. 21, the collecting container 60B keeps a posture reduced in terms of the engagement amount between the second projection 67 and the second stopper 77 (e.g., reduced from J1 (mounted) to J2) similarly to the mounting/demounting structure 5 according to the first exemplary embodiment (see FIG. 11B).

Modified Examples

The following modified examples may also be adopted without limitation to the mounting/demounting structures 5, 5B, and 5C according to the first to third exemplary embodiments and the image forming apparatus 1A that is an example of the apparatus 1 using the mounting/demounting structure 5, 5B, or 5C.

For example, the mountable/demountable object 6 in the mounting/demounting structure may be a mountable/demountable container that contains a substance such as liquid or gas instead of powder such as the developer, a replaceable component such as an electric component, a mechanical component, or an electronic component, or a mountable/demountable replacement package storing the replaceable component.

The receptacle 7 is not particularly limited as long as the receptacle 7 is structured based on the type of the mountable/demountable object 6.

The apparatus 1 using the mounting/demounting structure according to each exemplary embodiment of the present disclosure may be any apparatus that is based on the type of the mountable/demountable object 6.

The image forming apparatus 1A exemplified in the first exemplary embodiment or the like is not limited to the apparatus having the structure described above, and may be an image forming apparatus using a different structure. For example, if the mountable/demountable object 6 is a mountable/demountable ink container that contains ink, the image forming apparatus may be an image forming apparatus that forms images using ink, and the image forming system is not particularly limited.

The mounting/demounting structure according to each exemplary embodiment of the present disclosure may include a mountable/demountable object 6 that is mountable or demountable by being inserted or pulled in the vertical direction or in obliquely upward and downward directions, and a receptacle 7 including a housing portion that houses the mountable/demountable object. In this mounting/demounting structure, the housing portion of the receptacle 7 may have any structure as long as the mountable/demountable object 6 mounted on the receptacle 7 is housed while being covered in at least two directions. Also in this mounting/demounting structure, the mountable/demountable object has the first projection and the second projection, and the receptacle 7 has the first stopper and the second stopper.

The second projection 67 is not limited to the snap-fit component. For example, the second projection 67 may be a ratchet in which a protrusion engageable with the second stopper 77 is urged by an urging member such as a spring and is shifted to temporarily recede against an urging force when passing over the second stopper 77 while inserting or pulling the mountable/demountable object 6.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A mounting/demounting structure comprising:

a mountable/demountable object that is mountable or demountable by inserting or pulling the mountable/demountable object, the mountable/demountable object comprising:

a body;

a first projection provided at a first end of the body in a movable manner; and a second projection provided at a second end of the body in a shiftable manner; and a receptacle comprising:

a housing portion configured to, when the mountable/demountable object is mounted, house the mountable/demountable object while covering the mountable/demountable object in at least two directions;

a first stopper provided in the housing portion and configured to stop the first projection by engagement; and a second stopper provided in the housing portion and configured to stop the second projection by engagement, the mountable/demountable object comprising an abutment portion provided on the body and configured to abut against a part of the housing portion to keep a posture reduced in terms of an engagement amount between the second projection and the second stopper when the first projection is first disengaged from the first stopper and the mountable/demountable object is stopped at a tilt in the housing portion during demounting of the mountable/demountable object from the receptacle.

2. The mounting/demounting structure according to claim 1, wherein the abutment portion is positioned on an upstream side of a middle position along an inserting direction in which the mountable/demountable object is mounted.

3. The mounting/demounting structure according to claim 2, wherein the second projection is positioned on a downstream side of the middle position along the inserting direction in which the mountable/demountable object is mounted.

4. The mounting/demounting structure according to claim 3, wherein a portion of the second projection that is engageable with the second stopper is inclined toward an upstream side in a pulling direction in which the mountable/demountable object is demounted.

5. The mounting/demounting structure according to claim 4, wherein a portion of the second stopper that is engageable with the second projection is inclined toward a downstream side in the pulling direction in which the mountable/demountable object is demounted.

6. The mounting/demounting structure according to claim 4, wherein the second projection is provided at an upper end of the body.

7. The mounting/demounting structure according to claim 3, wherein the second projection is provided at an upper end of the body.

8. The mounting/demounting structure according to claim 2, wherein a portion of the second projection that is engageable with the second stopper is inclined toward an upstream side in a pulling direction in which the mountable/demountable object is demounted.

9. The mounting/demounting structure according to claim 8, wherein a portion of the second stopper that is engageable with the second projection is inclined toward a downstream side in the pulling direction in which the mountable/demountable object is demounted.

10. The mounting/demounting structure according to claim 8, wherein the second projection is provided at an upper end of the body.

11. The mounting/demounting structure according to claim 2, wherein the second projection is provided at an upper end of the body.

12. The mounting/demounting structure according to claim 1, wherein a portion of the second projection that is engageable with the second stopper is inclined toward an upstream side in a pulling direction in which the mountable/demountable object is demounted.

13. The mounting/demounting structure according to claim 12, wherein a portion of the second stopper that is engageable with the second projection is inclined toward a downstream side in the pulling direction in which the mountable/demountable object is demounted.

14. The mounting/demounting structure according to claim 12, wherein the second projection is provided at an upper end of the body.

15. The mounting/demounting structure according to claim 1, wherein the second projection is provided at an upper end of the body.

16. The mounting/demounting structure according to claim 15, wherein the second projection is a snap-fit component engageable with the second stopper after being shifted downward by deflection.

17. The mounting/demounting structure according to claim 1, wherein the abutment portion is a guide protrusion or a part of the guide protrusion, the guide protrusion being configured to guide the mountable/demountable object along an inserting direction and a pulling direction.

18. An apparatus comprising the mounting/demounting structure according to claim 1.

19. The apparatus according to claim 18, wherein the apparatus comprises a plurality of the mountable/demountable objects, and wherein the plurality of the mountable/demountable objects are mounted on the housing portion side by side in proximity to each other.

20. A mountable/demountable object that is mountable on or demountable from a receptacle by inserting or pulling the mountable/demountable object, the mountable/demountable object comprising:

a body;

a first projection provided at a first end of the body in a movable manner; and a second projection provided at a second end of the body in a shiftable manner, the receptacle comprising:

a housing portion configured to, when the mountable/demountable object is mounted, house the mountable/demountable object while covering the mountable/demountable object in at least two directions;

a first stopper provided in the housing portion and configured to stop the first projection by engagement; and a second stopper provided in the housing portion and configured to stop the second projection by engagement, the mountable/demountable object comprising an abutment portion provided on the body and configured to abut against a part of the housing portion to keep a posture reduced in terms of an engagement amount between the second projection and the second stopper when the first projection is first disengaged from the first stopper and the mountable/demountable object is stopped at a tilt in the housing portion during demounting of the mountable/demountable object from the receptacle.

* * * * *